US012247389B2

(12) United States Patent
Del Rio et al.

(10) Patent No.: US 12,247,389 B2
(45) Date of Patent: Mar. 11, 2025

(54) HOLLOW STRUCTURAL SECTION CONNECTOR AND METHODS OF USE OF SAME

(71) Applicant: Blokable, LLC, Sacramento, CA (US)

(72) Inventors: Nelson Del Rio, Redding, CA (US); Timothy Bryce Miller, Sacramento, CA (US); Przemyslaw Olszewski, Portland, OR (US); Phong Anh Le, Culver City, CA (US); Roger Paul Young, Newport Beach, CA (US); Dayu Li, San Jose, CA (US); Faizan Sidiqui, Newport Beach, CA (US)

(73) Assignee: Blokable, LLC, Sacramento, CA (US)

( * ) Notice: Subject to any disclaimer, the term of this patent is extended or adjusted under 35 U.S.C. 154(b) by 253 days.

(21) Appl. No.: 17/945,880

(22) Filed: Sep. 15, 2022

(65) Prior Publication Data

US 2023/0121784 A1 Apr. 20, 2023

Related U.S. Application Data

(60) Provisional application No. 63/246,662, filed on Sep. 21, 2021.

(51) Int. Cl.
*E04B 1/24* (2006.01)

(52) U.S. Cl.
CPC .... *E04B 1/2403* (2013.01); *E04B 2001/2415* (2013.01); *E04B 2001/2457* (2013.01)

(58) Field of Classification Search
CPC .. E04B 1/24; E04B 1/2403; E04B 2001/2415; E04B 2001/2457; E04B 2001/1972; F27D 1/18; A47G 1/20

(Continued)

(56) References Cited

U.S. PATENT DOCUMENTS 3,666,298 A * 5/1972 Reilly ..... F16B 12/40 403/172
5,066,161 A * 11/1991 Pinney ..... A47B 47/0008 403/219

(Continued)

FOREIGN PATENT DOCUMENTS

JP 2003056059 A 2/2003
JP 2006009437 A 1/2006

(Continued)

OTHER PUBLICATIONS

Machine translation of JP 2006009437.*
International Search Report and Written Opinion for PCT/US2022/076488 dated Dec. 28, 2022, 12 pages.

*Primary Examiner* — Paola Agudelo
(74) *Attorney, Agent, or Firm* — Cozen O'Connor

(57) ABSTRACT

A bracket includes a first wing, a second wing and a bridge that connects the first wing to the second wing. The first wing has a first inner surface and a first outer surface. The second wing has a second inner surface and a second outer surface. The bridge extends from the first inner surface to the second inner surface thereby coupling the first wing to the second wing such that the first inner surface is normal to a first direction, and the first inner surface is parallel to the second inner surface. The bridge includes a front edge and a rear edge. The front edge forms a recess that extends into the bridge towards the rear edge along a second direction that is perpendicular to the first direction, and the recess terminates within the bridge prior to reaching the rear edge.

22 Claims, 15 Drawing Sheets

(58) Field of Classification Search
USPC ..... 52/215
See application file for complete search history.

(56) References Cited

U.S. PATENT DOCUMENTS 5,259,685 A * 11/1993 Gilb ..... E04B 1/26 403/231
5,440,844 A * 8/1995 Chihara ..... E04B 1/2403 52/656.9
5,605,410 A * 2/1997 Pantev ..... F16B 7/0486 403/174
5,660,017 A * 8/1997 Houghton ..... E04H 9/024 52/283
5,820,289 A * 10/1998 Kern ..... H05K 7/183 403/231
6,591,573 B2 * 7/2003 Houghton ..... E04B 1/2403 52/655.1
9,121,433 B1 * 9/2015 Bacon ..... F16B 7/0446
9,392,890 B1 * 7/2016 Royak ..... A47G 1/205
10,900,215 B1 * 1/2021 Alrubaidi ..... E04H 9/024
11,236,502 B2 * 2/2022 Houghton ..... E04B 1/1903
11,732,459 B2 * 8/2023 Bowron ..... E04B 1/5825 52/655.1
2015/0275501 A1 * 10/2015 Houghton ..... E04H 9/024 52/854
2015/0292194 A1 10/2015 Calafatis et al.
2017/0306610 A1 10/2017 Leahy
2018/0223521 A1 * 8/2018 Uno ..... E04B 1/215
2018/0245331 A1 8/2018 Tang et al.
2018/0266099 A1 * 9/2018 Lippert ..... E04B 1/2403
2019/0249409 A1 * 8/2019 Boyd ..... E04B 1/2403
2022/0136230 A1 * 5/2022 Pellock ..... E04B 1/2608 52/696

FOREIGN PATENT DOCUMENTS

KR 20180094269 A 8/2018
KR 102217685 B1 2/2021
WO 2019213439 A1 11/2019

* cited by examiner

HOLLOW STRUCTURAL SECTION CONNECTOR AND METHODS OF USE OF SAME

BACKGROUND

Technical Field

The present disclosure relates generally to modular structure construction, and specifically to connectors used during the construction of said modular structures to join hollow structural section members.

Description of the Related Art

In recent years, the availability of affordable housing has become an issue for many communities around the country and throughout the world. Certain segments of the population, such as the poor or elderly, may be especially susceptible to the increased cost and decreased availability of housing. As a result, many people are either living in substandard housing or are forced to commute long distances to work at their jobs.

One of the issues exacerbating this housing crisis is the amount of time and resources that are necessary to construct a single family home or a multi-unit dwelling. Such constructions times can take anywhere from several weeks to several months or more, and may require teams of workers and contractors to construct a home or dwelling at a construction site.

In addition to time constraints, current building practices rely upon a division of labor and responsibilities to incorporate technology into the home or dwelling unit. As such, a primary contractor may be responsible for erecting the structural components that are used to modify walls or other structural components to incorporate various types of technologies and capabilities, including networking, communications, and sensing capabilities, into the structure.

Modular structures may be used to decrease construction time for various types of dwelling units. At least portions of such modular units may pre-fabricated at a facility located away from the construction site, and shipped to the construction site to be quickly and efficiently incorporated into the modular structure. Because such portions may be prefabricated to be included within multiple types of modular structures, the cost of such fabrication may be kept relatively low. One example of a known modular structure is described in PCT Application No. PCT/US2019/030465, filed May 2, 2019, the disclosure of which is hereby incorporated in its entirety Referring to FIG. 1, a known modular structure 100 has a subfloor 102 that may be tilted to slope downwardly towards an interior portion 104 of the modular structure 100. The modular structure 100 may have a length 106, a width 108, and a height 110. In some implementations, the modular structure 100 may also include a frame 112 and a floor 114. The frame 112 may be comprised of metal (e.g., steel), a composite material (e.g., oriented strand board, fiber reinforced polymers), or other materials. The frame 112 may extend through one or more of the length 106, the width 108, and/or the height 110 of the modular structure 100, and may delineate an interior portion 122 of the modular structure 100 from an exterior 124 of the modular structure 100. All or substantially all of the materials employed in the modular structure 100 may be fireproof or fire resistant (e.g., glass fiber reinforced sheetrock, steel, mineral wool) and/or may have a fire retardant coating or covering thereon.

The frame 112 may include one or more structural frame members 118. Each of the structural members of the frame 112 may extend along one or more of the length 106, width 108, and/or height 110 of the modular structure 100. The structural members may be used to outline a shape for the modular structure 100. For example, the structural members may include a set of vertical structural frame members 118*a*, a set of lower horizontal structural frame members 118*b*, and a set of upper horizontal structural frame members 118*c* that may be used to outline a three dimensional shape, such as a cuboid. As such, the set of lower horizontal structural frame members 118*b* may include a first pair of opposing lower horizontal structural frame members 118*b* that extend along the length 106 of the modular structure 100, and a second pair of opposing lower horizontal structural frame members 118*b* that extend along the width 108 of the modular structure 100.

The set of upper horizontal structural frame members 118*c* in such an implementation may include a first pair of opposing upper horizontal structural frame members 118*c* that extend along the length 106 of the modular structure 100, and a second pair of opposing upper horizontal structural frame members 118*c* that extend along the width 108 of the modular structure 100. The vertical structural frame members 118*a* in such an implementation may extend between the lower horizontal structure frame members 118*b* and the upper horizontal structural frame members 118*c*. In such an implementation, the set of lower horizontal members 118*b* may form a perimeter 120 of the modular structure 100. In some implementations, the structural members may be used to outline other types of shapes for the modular structure 100.

The dimensions of the modular structure 100 (e.g., the length 106, the width 108, and/or the height 110) may be based upon one or more criteria. Such criteria may reflect the environment and/or usage of the modular structure 100. For example, the dimensions of the modular structure 100 may be the same or substantially similar to the dimensions of one or more types of intermodal container (e.g., 20-foot containers or 40-foot containers) to facilitate transport via various modes of transportation (e.g., ships, trains, trucks) to a location. In such an implementation, the modular structure 100 may include other features or components that reflect the environment and/or usage of the modular structure 100. For example, in implementations in which the modular structure 100 has the same or substantially similar dimensions to a type of intermodal container, the modular structure 100 may include one or more couplers (e.g., twist lock fittings) at appropriate locations such that the modular structure 100 may be selectively, releaseably, physically coupled and secured to other intermodal containers for transport.

In some implementations, the modular structure 100 may include a floor 114 that extends across some or all of the length 106 and/or the width 108 of the modular structure 100 proximate a bottom portion 128 of the modular structure 100. The floor may be physically coupled to the frame 112 using one or more physical couplers (e.g., bolts, screws, nails, staples, adhesives). The floor 114 may include an upper surface 130 that faces toward the interior portion 122 of the modular structure 100 and an opposing lower surface 132 that faces toward the exterior 124 of the modular structure. The upper surface 130 may be separated from the opposing lower surface 132 by a thickness 134 of the floor 114 in which one or both of the upper surface 130 and the lower surface 132 may be substantially parallel to a horizontal plane. As such, the upper surface 130 may be used to support items located within the interior portion 122 of the modular structure.

In some implementations, the floor 114 may be supported by one or more support members that may extend across length 106 and/or the width 108 of the modular structure. For example, in some implementations, one or more metal beams may extend across the width 108 of the modular structure 100 along the bottom portion 128 of the modular structure 100. The lower surface 132 of the floor 114 may thereby rest on top of such support members.

The modular structure 100 may include one or more sealing systems 148 that may be used to create a waterproof seal and/or an air-tight seal within the modular structure 100 or between components thereof.

A number of structural frame members 118 may be physically coupled together using a connector 150, as shown in the call out in FIG. 1. Each connector 150 may include a first leg 152 and a second leg 154 in which the first leg 152 and the second leg 154 are arranged at an angle to each other. The angle formed by the first leg 152 and the second leg 154 may be based, at least in part, on the shape of the modular structure 100. In implementations in which the modular structure 100 forms a cuboid, as shown in FIG. 1, the first leg 152 and the second leg 154 may be arranged at a ninety degree angle with respect to each other.

Each of the first leg 152 and the second leg 154 may have a respective cavity 156 (one shown) with an opening 158 that faces away from the connector 150. The opening 158 and/or the cavity 156 may be shaped and dimensioned to receive one of the structural frame members 118 in the modular structure 100. In some implementations, the opening 158 and/or cavity 156 may have dimensions that are only slightly larger than the outside dimensions of the structural frame member 118. As such the structural frame member 118 may form a close fitting or tight physical coupling with the opening 158 and/or cavity 156. In some implementations, one or more of the structural frame members 118 and the connector 150 may include a hollow cavity. In such implementations, such hollow cavities may be used to run one or more wires, cables, and/or optical fibers, as discussed below.

In some implementations, the connector 150 may have corresponding sidewall apertures 160 on opposing sidewalls of either or both of the first leg 152 and/or the second leg 154 (one shown in FIG. 1). Each pair of opposing sidewall apertures 160 may align with a corresponding frame member aperture 162 when the structural frame member 118 is inserted into the cavity 156. The frame member aperture 162 may extend through the structural frame member 118 such that the structural frame member 118 may be selectively, releaseably, physically secured to the connector 150 by, for example, inserting a pin 164 through the opposing sidewall apertures 160 and the frame member aperture 162.

The connector 150 may include a post 166 that may be oriented in a vertical direction to be physically coupled to one of the vertical structural frame members 118*a*. In some implementations, the post 166 may be sized to be securely inserted into an opening 168 in the vertical structural frame member 118*a*. In some implementations, the vertical structural frame member 118*a* may include opposing sidewall apertures 162, and the post 166 may include a corresponding post aperture 170 that extends through the post 166. As such, the post 166 and the vertical structure frame member 118*a* may be selectively, releasably physically secured to the connector 150 via the post 166.

BRIEF SUMMARY

Multiple modular structures may be coupled together (e.g., vertically, horizontally, or both) to construct a larger building (e.g., a multi-unit dwelling or a commercial building). Methods of construction employing the use of modular structures present challenges regarding access to portions of those modular structures. For example, coupling one modular structure vertically with another modular structure may result in limited access to upper surfaces of the lower modular structure and lower surfaces of the upper modular structure as the upper and lower surfaces face each other in close proximity thereby limiting space for tools to engage components on those upper and lower surfaces.

Additionally, dependent on the region in which the building is constructed, hazards (e.g., environment hazards) may result in failure of structural components of the building. It may be desirable to control one or more facets (e.g., location, specific component, etc.) of such potential failures. Such control may prevent certain failure modes (e.g., total collapse), and may further facilitate repairs conducted after a failure event occurs.

More generally, a connector that connects structural members within a structural frame (e.g., hollow structural section beams and columns), and that also connects adjacent structural frames (e.g., first and second hollow structural section columns) may result in a more stable modular structure, as well as reduced costs due to a reduction in parts and labor used in the production of such modular structures.

According to one aspect of the disclosure, a bracket includes a first wing, a second wing, and a bridge. The first wing has a first inner surface and a first outer surface that is opposite the first inner surface. The second wing has a second inner surface and a second outer surface that is opposite the second inner surface. The bridge extends from the first inner surface to the second inner surface thereby coupling the first wing to the second wing such that the first inner surface is normal to a first direction. The bridge also couples the first wing to the second wing such that the first inner surface is parallel to the second inner surface. The bridge has a front edge and a rear edge opposite the front edge. The front edge forms a recess that extends into the bridge towards the rear edge along a second direction that is perpendicular to the first direction. The recess terminates within the bridge prior to reaching the rear edge.

According to another aspect of the disclosure, a hollow structural section joint includes a first hollow structural section, a second hollow structural section, and a bracket secured to both the first hollow structural section and the second hollow structural section. The bracket includes a first wing, a second wing, and a bridge. The first wing has a first inner surface and a first outer surface that is opposite the first inner surface. The second wing has a second inner surface and a second outer surface that is opposite the second inner surface. The bridge extends from the first inner surface to the second inner surface thereby coupling the first wing to the second wing such that the first inner surface is normal to a first direction. The bridge also couples the first wing to the second wing such that the first inner surface is parallel to the second inner surface. The bridge has a front edge and a rear edge opposite the front edge. The front edge forms a recess that extends into the bridge towards the rear edge along a second direction that is perpendicular to the first direction. The recess terminates within the bridge prior to reaching the rear edge.

According to one aspect of the disclosure, a method of securing a vertical structural member to a horizontal structural member to form a joint includes abutting a lower surface of a bridge of a bracket with an upper surface of the horizontal structural member such that a recess of the bracket is aligned with a hole in the upper surface thereby forming a first interface between the lower surface of the bridge and the upper surface of the horizontal structural member. The method further includes securing the bracket to the horizontal structural member by welding along at least a portion of the first interface.

The method further includes abutting a first inner surface of a first wing of the bracket with a first outer surface of the vertical structural member thereby forming a second interface between the first wing and the first outer surface of the vertical structural member, wherein the first inner surface is perpendicular to the lower surface of the bridge, and abutting a second inner surface of a second wing of the bracket with a second outer surface of the vertical structural member thereby forming a third interface between the second wing and the second outer surface of the vertical structural member, wherein the second inner surface is parallel to the first inner surface, and the second outer surface is parallel to the first outer surface. The method further includes securing the bracket to the vertical structural member by welding along at least a portion of the second interface and by welding along at least a portion of the third interface.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn, are not necessarily intended to convey any information regarding the actual shape of the particular elements, and may have been solely selected for ease of recognition in the drawings.

DETAILED DESCRIPTION

Figure 1:
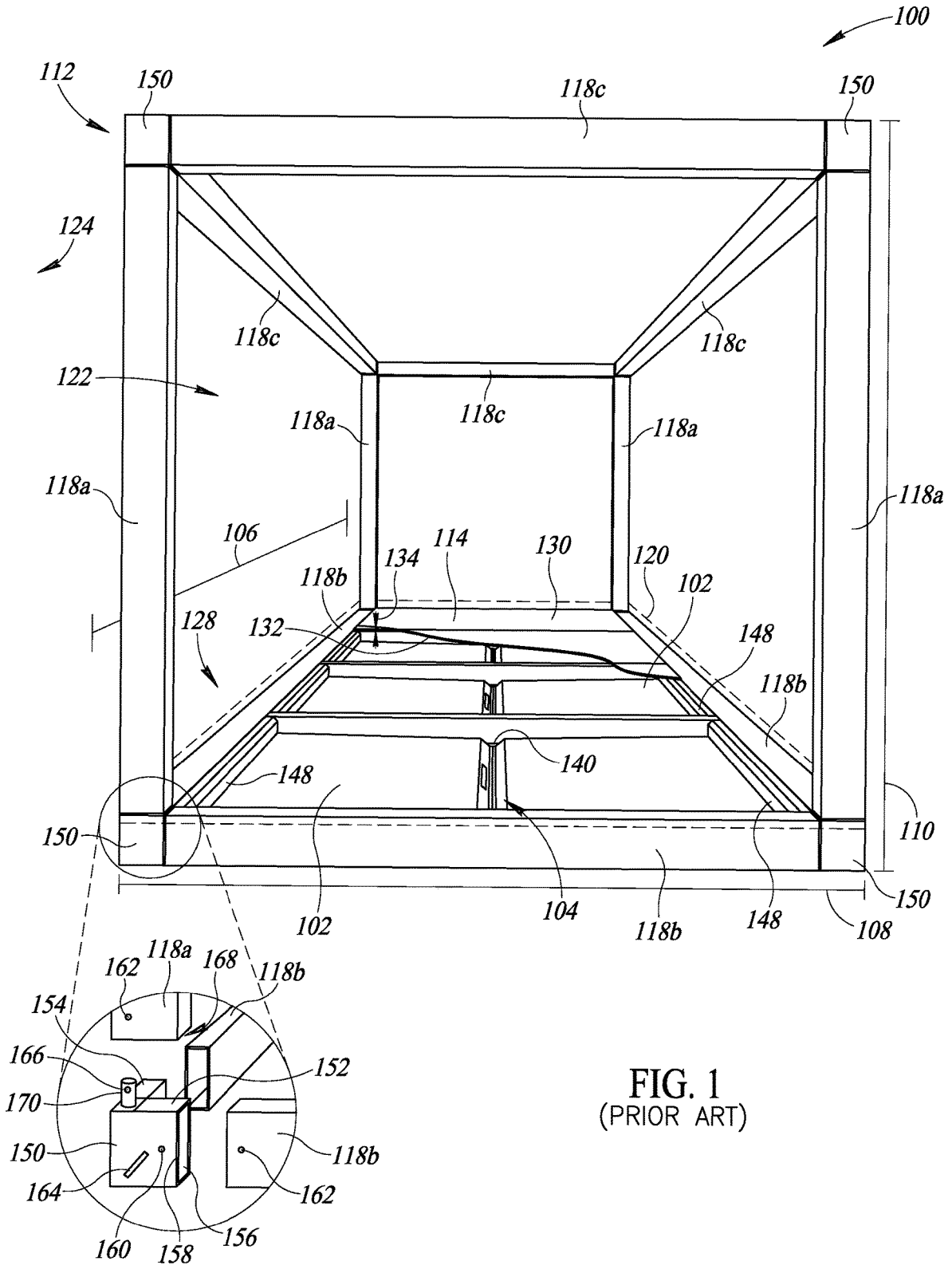
FIG. 1 (PRIOR ART)
FIG. 1 is a front, perspective view of a known modular structure.

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with connectors used in the construction of modular structures have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment," "an embodiment," or "an aspect of the disclosure" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its broadest sense, that is as meaning "and/or" unless the content clearly dictates otherwise.

Reference herein to two elements "facing" or "facing toward" each other indicates that a straight line can be drawn from one of the elements to the other of the elements without contacting an intervening solid structure. Reference herein to two elements being "directly coupled" indicates that the two elements physically touch with no intervening structure between. Reference herein to a direction includes both vectors that make up said direction. For example a vertical direction includes both an "up" vector and a "down" vector, which is opposite the "up" vector. Reference to an element extending along a direction means the element extends along one or both of the vectors that make up the direction.

The term "between" as used herein in reference to a first element being between a second element and a third element with respect to a direction means that the first element is closer to the second element as measured along the direction than the third element is to the second element as measured along the direction. The term "between" includes, but does not require that the first, second, and third elements be aligned along the direction.

Recitation of ranges of values herein are merely intended to serve as a shorthand method of referring individually to each separate value falling within the range including the stated ends of the range, unless otherwise indicated herein, and each separate value is incorporated into the specification as if it were individually recited herein.

Aspects of the disclosure will now be described in detail with reference to the drawings, wherein like reference numbers refer to like elements throughout, unless specified otherwise. Certain terminology is used in the following description for convenience only and is not limiting. The term "plurality," as used herein, means more than one. The terms "a portion" and "at least a portion" of a structure include the entirety of the structure.

The headings and Abstract of the Disclosure provided herein are for convenience only and do not interpret the scope or meaning of the embodiments.

Figure 2:
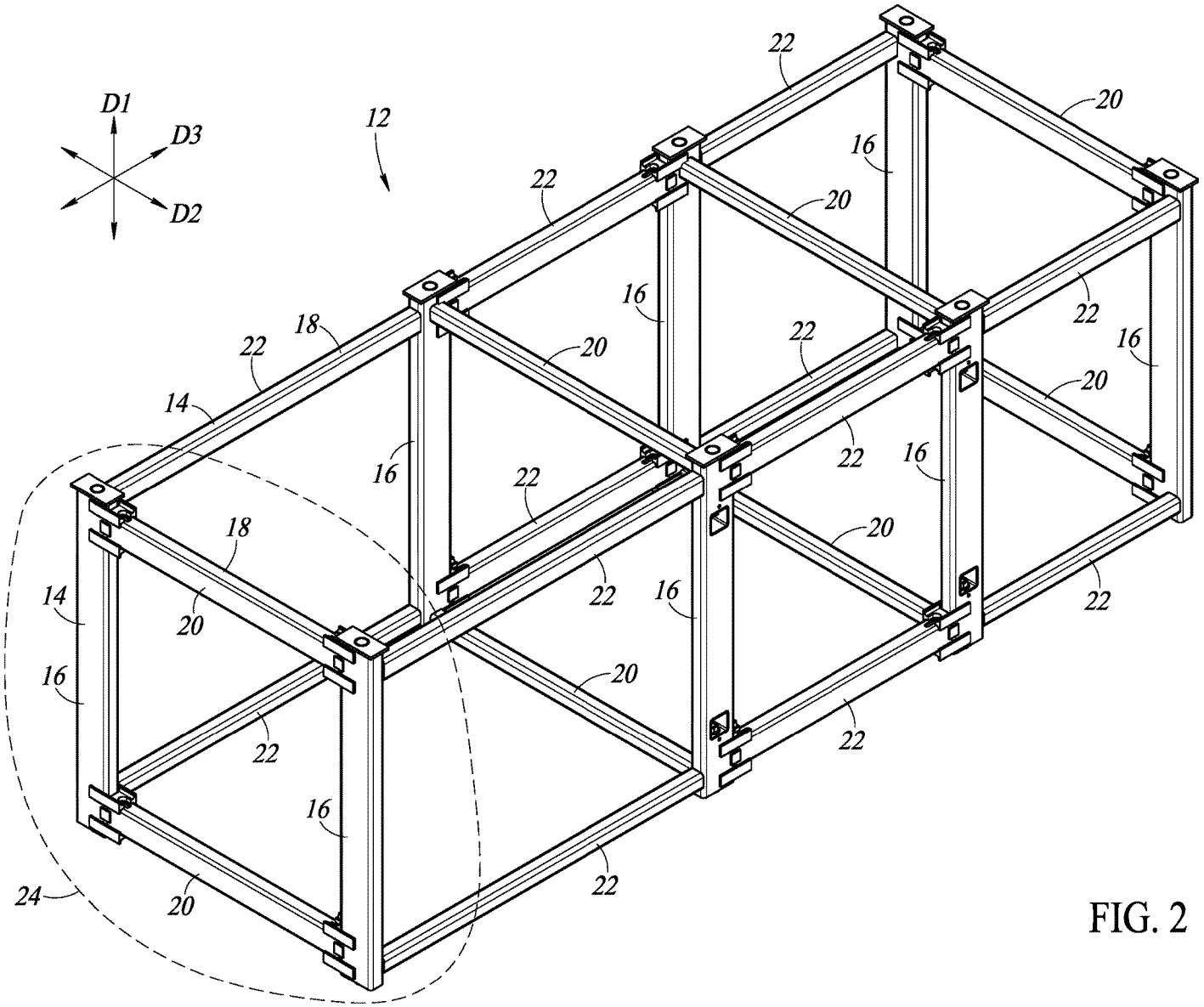
FIG. 2 is an isometric view of a structural frame according to one embodiment.

Referring to FIG. 2, a structural frame 12 has a three-dimensional shape (e.g., a rectangular prism, a cube, or a cuboid). The structural frame 12 may include a plurality of structural members 14. As shown, the plurality of structural members 14 may include vertical structural members 16 (also referred to herein as columns) and horizontal structural members 18 (also referred to herein as beams). According to one aspect of the disclosure, at least some of the plurality of structural members 14 may be tubular members (e.g. hollow structural sections, also referred to herein as "HSS").

One or more of the vertical structural members 16 may be arranged such that the vertical structural members 16 are elongate along a first direction D1, for example a vertical direction (e.g., the direction perpendicular to the surface upon which the structural frame 12 rests). One or more of the horizontal structural members 18 may include lateral structural members 20 and longitudinal structural members 22. The lateral structural members 20 may be elongate along a second direction D2, which may be perpendicular to the first direction D1. The longitudinal structural members 22 may be elongate along a third direction D3, which may be perpendicular to at least one of, for example both, the first direction D1 and the second direction D2.

The plurality of structural members 14 within the structural frame 12 may be different lengths. For example, the length of the vertical structural members 16 as measured along the first direction D1 may be different than the length of one or both of the lateral structural members 20 as measured along the second direction D2 and the longitudinal structural members 22 as measured along the third direction D3. According to another embodiment, the length of the vertical structural members 16 as measured along the first direction D1 may be the same as the length of one or both of the lateral structural members 20 as measured along the second direction D2 and the longitudinal structural members 22 as measured along the third direction D3.

According to one embodiment, each of the vertical structural members 16 within the structural frame 12 may be the same length so as to establish a constant height of the structural frame 12. Similarly, each of the lateral structural members 20 within the structural frame 12 may be the same length so as to establish a constant width of the structural frame 12. Similarly, each of the longitudinal structural members 22 within the structural frame 12 may be the same length so as to establish a constant depth of the structural frame 12.

It will be understood that one or more of the vertical structural members 16 may be a different length compared to others of the vertical structural members 16 within the structural frame 12 to establish a varying height of the structural frame 12. Similarly, one or more of the lateral structural members 20 may be a different length compared to others of the lateral structural members 20 within the structural frame 12 to establish a varying width of the structural frame 12. Similarly, one or more of the longitudinal structural members 22 may be a different length compared to others of the longitudinal structural members 22 within the structural frame 12 to establish a varying depth of the structural frame 12.

The structural frame 12 may be described as including a number, for example 2 or more, moment frames 24. Each of the moment frames 24 may include two or more moment connections. According to one embodiment, a moment connection is a joint that allows the transfer of bending moment forces between two members, such as a column and a beam. Members of the moment frame 24 are rigidly connected, for example by welding or a connector, so as to resist bending moments and shear forces applied to the modular structure 10.

The moment frames 24, as shown, may include two of the vertical structural members 16 each coupled to two of the horizontal structural members 18 by respective moment connections. Thus, according to one embodiment, the moment frame 24 may include four moment connections. It will be appreciated by those of skill in the art that the moment frame 24 may include other numbers of members and moment connections. For example, the moment frame 24 may be in the form of a goalpost having two of the vertical structural members 16 and one of the horizontal structural members 18 and two moment connections joining the horizontal structural member 18 to both of the vertical structural members 16.

According to one embodiment, the structural frame 12 may include a series of moment frames 24 that each include a pair of the vertical structural members 16 and a pair of the lateral structural members 20 connecting the pair of the vertical structural members 16. Adjacent ones of the series of moment frames 24 may be connected by a plurality, for example four, of the longitudinal structural members 22. According to one embodiment, the longitudinal structural members 22 connecting adjacent ones of the moment frames 24 may be non-rigidly connected, for example by friction fit or protrusion and recess, to the adjacent moment frames 24.

As shown, the moment frame 24 may be in the form of a closed shape, such as a square tube 26, that includes two vertical structural members 16, and two horizontal structural members 18, for example two lateral structural members 20, each coupled to both of the two vertical structural members 16. According to one embodiment the modular structure 10 may include a plurality of the moment frames 24.

The structural frame 12 may include one or more connectors 30 that attach and secure one of the vertical structural members 16 to at least one of the horizontal structural members 18. According to one embodiment, some of the vertical structural members 16 may be joined to an adjacent horizontal structural members 18 with one of the connectors, while others of the adjacent horizontal structural members 18 may be joined by another method (e.g., directly welding the two members). According to another embodiment, one or more of the vertical structural members 16 may be joined to all of the adjacent horizontal structural members 18 with respective ones of the connectors 30.

Figure 3:
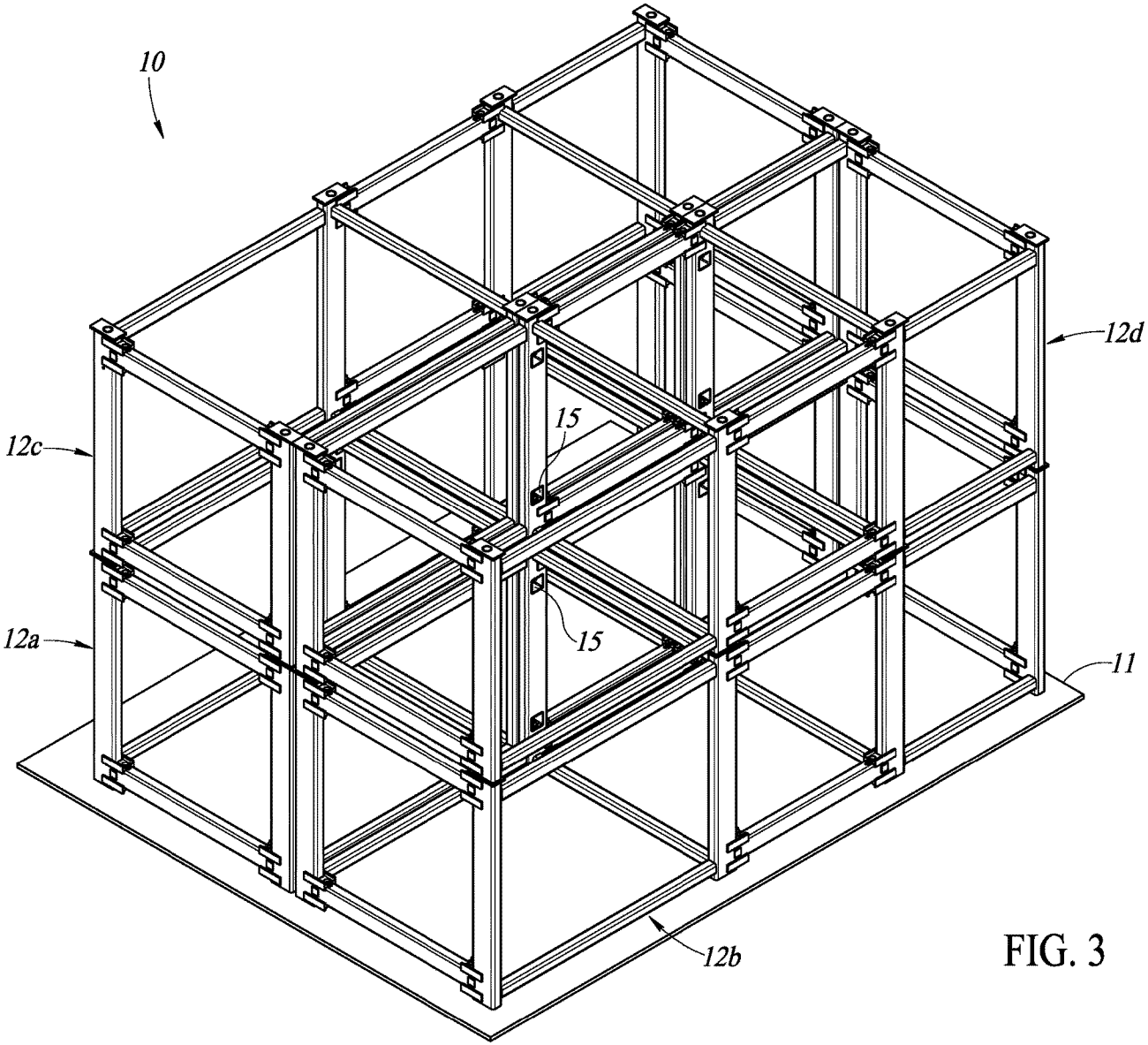
FIG. 3 is an isometric view of a modular structure that includes a plurality of the structural frames illustrated in FIG. 2.
Figure 4:
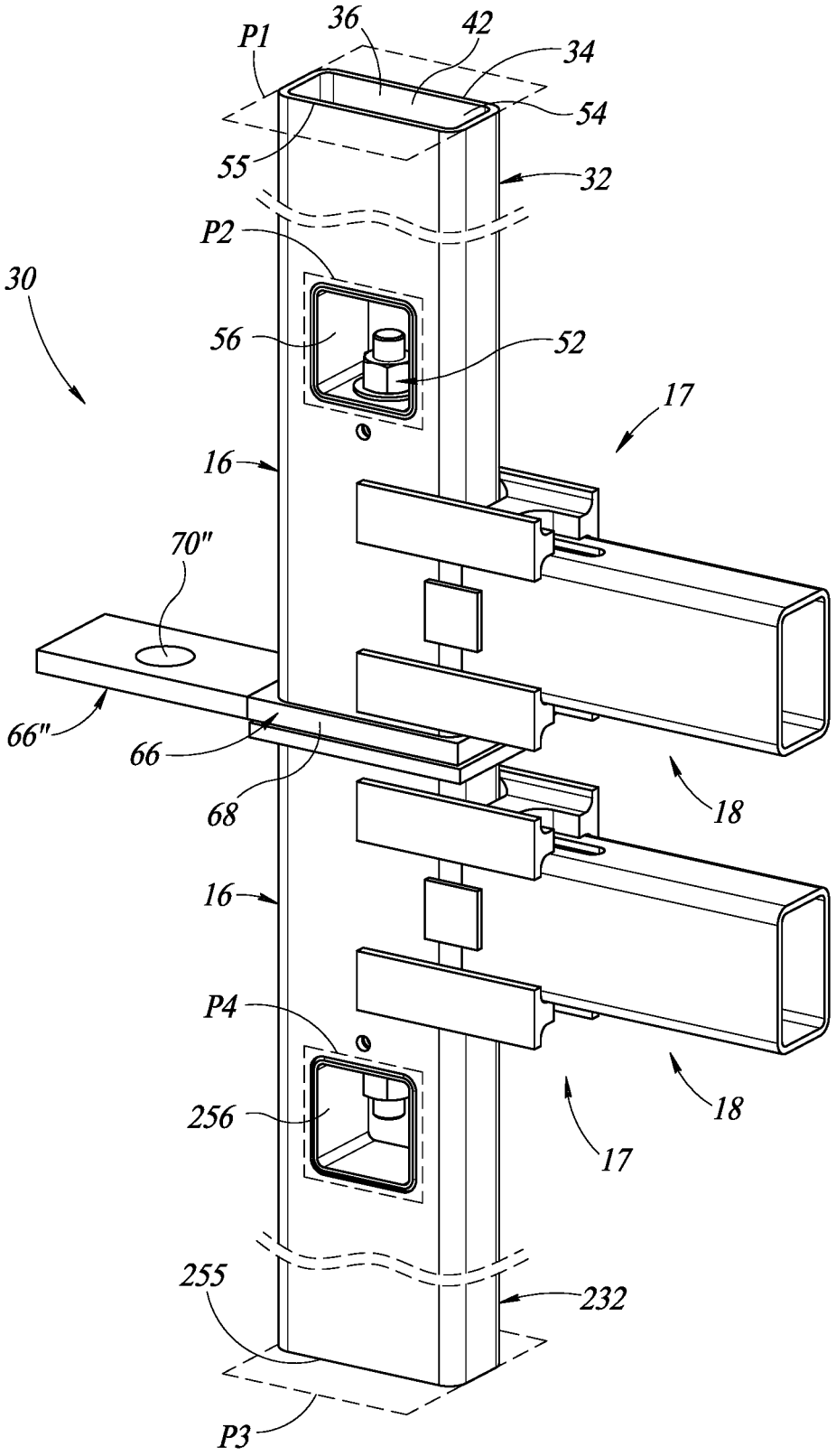
FIG. 4 is an isometric view of a connector, according to one embodiment.
Figure 5:
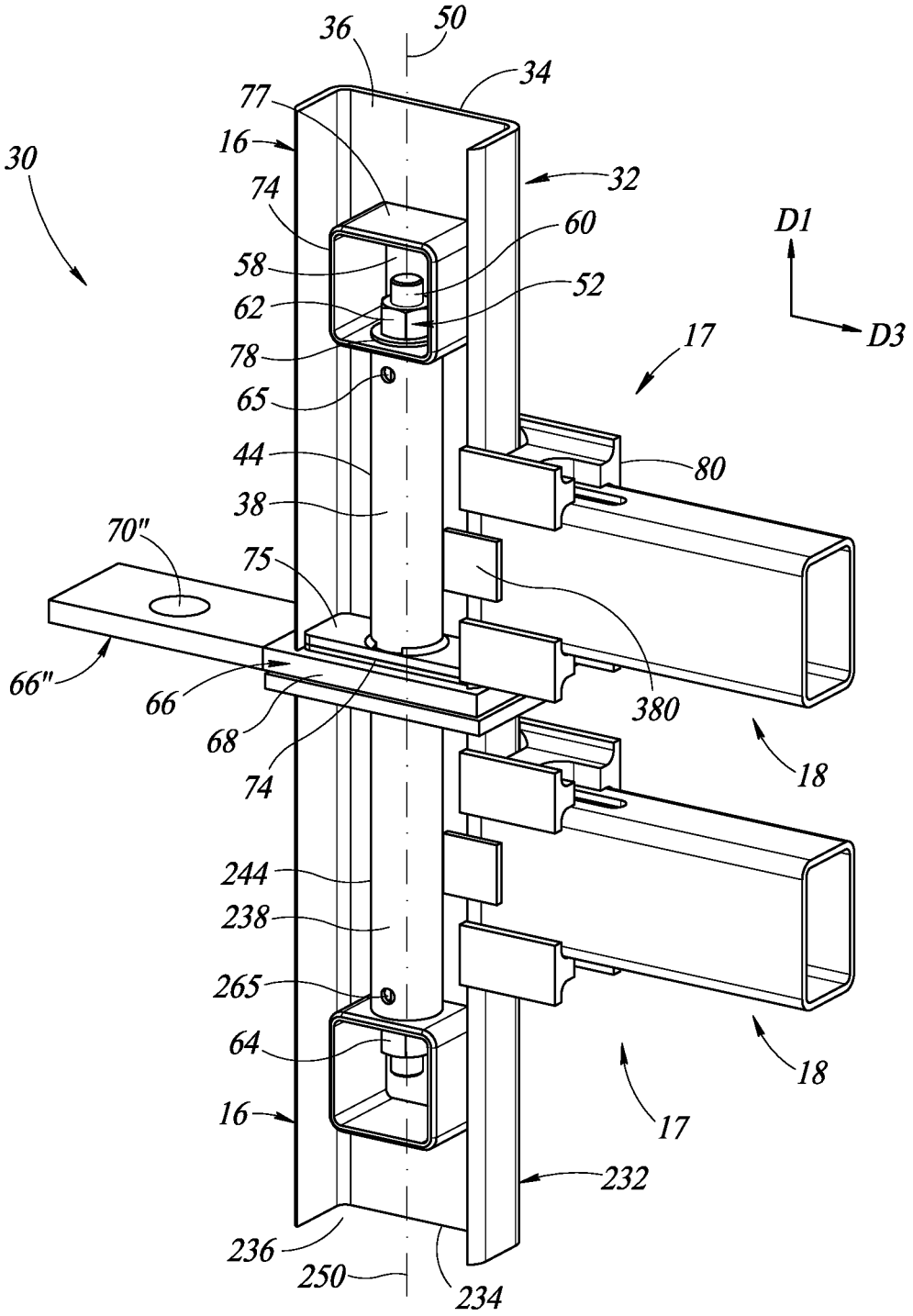
FIG. 5 is an isometric view of the connector illustrated in FIG. 4 with selected exterior surfaces removed to better show the arrangement of internal components within the connector.

Referring to FIGS. 2 and 3, a plurality of the structural frames 12 may be positioned and secured relative to one another to assemble a modular structure 10. According to one embodiment, a first structural frame 12*a* may be delivered to a location (e.g., as an assembled unit) and secured in a desired position. For example, a base plate 11 (e.g., a metal base plate) may be present at the location, and the first structural frame 12*a* may be secured (e.g., welded) to it. According to one embodiment, one or more of the vertical structural members 16 (e.g., the bottom of all eight of the vertical structural members 16 shown), may be welded to the metal base plate or otherwise secured to the ground.

A second structural frame 12*b* may be secured adjacent to the first structural frame 12*a*. The second structural frame 12*b* may be secured (e.g., welded) to the metal base plate as the first structural frame 12*a*. According to one embodiment, one or more of the vertical structural members 16 (e.g., the bottom of up to six of the vertical structural members 16 shown), may be welded to the metal base plate or otherwise secured to the ground. Note that the two middle vertical structural members 16 that face the first structural frame 12*a* may not be accessible to secure to the metal base plate (e.g., if a floor, such as the floor 114 in FIG. 1, is already installed that covers the bottom of the vertical structural members 16).

The second structural frame 12*b* may be secured directly to the first structural frame 12*a*. According to one embodiment, a top of at least one pair of the vertical structural members 16 of the first structural frame 12*a* and the second structural frame 12*b* may be secured (e.g., welded) to one another. For example, the adjacent vertical structural members 16 that make up the four pairs of vertical structural members 16 may be welded together.

A third structural frame 12*c* may be secured on top of the first structural frame 12*a*. According to one embodiment, a bottom of at least one of the vertical structural members 16 of the third structural frame 12*c* may be secured (e.g., welded) to a top of at least one of the vertical structural members 16 of the first structural frame 12*a*. As shown, all (e.g., four, six, eight, etc.) of the vertical structural members 16 of the third structural frame 12*c* may be secured to a vertically adjacent, respective one of the vertical structural members 16 of the first structural frame 12*a*.

A fourth structural frame 12*d* may be secured on top of the second structural frame 12*b*. According to one embodiment, a bottom of at least one of the vertical structural members 16 of the fourth structural frame 12*d* may be secured (e.g., welded) to a top of at least one of the vertical structural members 16 of the second structural frame 12*b*. However, after placement of the fourth structural frame 12*d* on top of the second structural frame 12*b*, a junction of some of the vertical structural members 16 of the third structural frame 12*c* and the respective ones of the vertically adjacent vertical structural members 16 of the second structural frame 12*b* may be inaccessible (also referred to herein as a blind connection location).

Thus, one embodiment of the connector 30 may include components 15 (described in further detail below) that facilitate coupling blind pairs of adjacent vertical structural members 16 from vertically stacked structural frames 12. As shown, the components that facilitate these blind couplings may be absent from one embodiment of the structural frame 12 (e.g., the first structural frame 12*a* and the third structural frame 12*c*) and present in another embodiment of the structural frame 12 (e.g., the second structural frame 12*b* and the fourth structural frame 12*d*) within the modular structure 10.

Referring to FIGS. 4 to 9, the connector 30 may include a first joint member 32. As shown in the illustrated embodiment, the first joint member 32 may be a hollow structural section column. The first joint member 32 may include an outer wall (e.g., a tubular outer wall 34) and an outer cavity 36 that is at least partially enclosed within the tubular outer wall 34. According to one embodiment, the outer cavity 36 may extend along an entire length of the first joint member 32.

The first joint member 32 may further include an inner wall (e.g., a tubular inner wall 38) positioned within the outer cavity 36, and an inner cavity 40 at least partially enclosed within the tubular inner wall 38 such that at least a portion of an inner surface 42 of the tubular outer wall 34 faces at least a portion of an outer surface 44 of the tubular inner wall 38. According to one embodiment, the outer cavity 36 may extend along an entire length of the first joint member 32. The tubular inner wall 38 may form a first opening 46 of the inner cavity 40 and a second opening 48 of the inner cavity 40. As shown, the first opening 46 may be spaced from the second opening 48 along an axis 50 that extends in a direction (e.g., the first direction D1).

According to one embodiment, the first joint member 32 may be symmetrical about one or more axes (e.g., vertically symmetrical about an axis located at a midpoint along the length of the first joint member).

The connector 30 may include a second joint member 232. According to one embodiment, the second joint member 232 may be identical to the first joint member 32 such that an entirety of the description of the first joint member 32 is applicable to the second joint member 232. According to one embodiment, the second joint member 232 may be similar to the first joint member 32 in that one or more components of the second joint member 232 are identical to corresponding components of the first joint member 32. As shown in the illustrated embodiment, the first joint member 32 and the second joint member 232 may be coupled such that one of the first joint member 32 and the second joint member 232 is oriented upside-down relative to the other of the first joint member 32 and the second joint member 232.

The connector 30 including first and second joint members 32, 232 with one or more identical components may result in increased efficiency through a reduced parts list, lower manufacturing costs, and more efficient assembly of the connector 30 as components are interchangeable.

The second joint member 232 may include an outer wall (e.g., a tubular outer wall 234) and an outer cavity 236 that is at least partially enclosed within the tubular outer wall 234. The second joint member 232 may further include an inner wall (e.g., a tubular inner wall 238) positioned within the outer cavity 236, and an inner cavity 240 at least partially enclosed within the tubular inner wall 238 such that at least a portion of an inner surface 242 of the tubular outer wall 234 faces at least a portion of an outer surface 244 of the tubular inner wall 238. The tubular inner wall 238 may form a first opening 246 of the inner cavity 240 and a second opening 248 of the inner cavity 240. As shown, the first opening 246 may be spaced from the second opening 248 along an axis 250, which may be collinear with the axis 50 when the first joint member 32 is coupled to the second joint member 232.

The connector 30 may include a fastener 52 that positions the first joint member 32 and the second joint member 232 relative to one another and secures the first joint member 32 and the second joint member 232 inhibiting relative movement of the first joint member 32 and the second joint member 232. As shown, the fastener 52 may extend through each of the first opening 46, the second opening 48, the first opening 246, and the second opening 248, simultaneously to vertically align one or more sets of corresponding components of the first joint member 32 and the second joint member 232 (e.g., the tubular outer walls 34 and 234, the tubular inner walls 38 and 238, etc.).

As described above in reference to FIGS. 2 and 3, the tubular inner walls 38, 238 and the fastener 52 may be part of the components 15 that facilitate a blind coupling of the first joint member 32 and the second joint member 232. Thus, embodiments of the connector 30 may be devoid of the tubular inner walls 38, 238 and the fastener 52.

According to one embodiment, the tubular outer wall 34 of the first joint member 32 may form a first opening 54 of the outer cavity 36. As shown, the first opening 54 may be formed within a first plane P1 that is normal to the axis 50. According to one embodiment, the first opening 54 is formed by a terminal end 55 of the tubular outer wall 34. The tubular outer wall 34 may form a second opening 56 of the outer cavity 36, and the second opening 56 of the outer cavity 36 may be formed within a second plane P2 that is perpendicular to the first plane P1. The tubular outer wall 34 may further form a third opening 58 of the outer cavity 36. As shown, the third opening 58 may be spaced from the second opening 56 in a direction normal to the second plane P2 and formed within a plane parallel to the second plane P2.

According to one embodiment, the tubular outer wall 234 of the second joint member 232 may form a first opening 254 of the outer cavity 236. As shown, the first opening 254 may be formed within a third plane P3 that is parallel to the axis 250. As shown, when the first joint member 32 is secured to the second joint member 232, the first plane P1 may be parallel to the third plane P3. According to one embodiment, the first opening 254 is formed by a terminal end 255 of the tubular outer wall 234. The tubular outer wall 234 may form a second opening 256 of the outer cavity 236, and the second opening 256 of the outer cavity 236 may be formed within a fourth plane P4 that is perpendicular to the third plane P3.

As shown, when the first joint member 32 is secured to the second joint member 232, the fourth plane P4 may be coplanar with the second plane P2, such that the second opening 256 is formed within the second plane P2. The tubular outer wall 234 may further form a third opening 258 of the outer cavity 236. As shown, the third opening 258 may be spaced from the second opening 256 in a direction normal to the fourth plane P4 and formed within a plane parallel to the fourth plane P4. When the first joint member 32 is secured to the second joint member 232 the third opening 58 and the third opening 258 may be coplanar.

The fastener 52 may include at least one actuator that is rotatable about an axis (e.g., the axis 50) to apply compression to the first joint member 32 and the second joint member 232. According to one embodiment, the fastener 52 may include an externally threaded rod 60 and the at least one actuator may include a first internally threaded nut 62. As shown, the first internally threaded nut 62 may be threaded onto the externally threaded rod 60 and positioned at a location spaced radially inward from the second opening 56 of the outer cavity 36 with respect to the axis 50. In other words, a radial ray that extends perpendicularly from the axis 50 that intersects both the threaded nut 62 and the second opening 56, will intersect the threaded nut 62 first, and then intersect the second opening 56. The at least one actuator may include a second internally threaded nut 64 threadable onto the externally threaded rod 60 so as to be positioned at a location spaced radially inward from the second opening 256 of the outer cavity 236 with respect to the axis 250.

As shown, the second and third openings 56, 58 may be positioned above a lateral coupler 17 (described in greater detail below) of the connector 30 that is secured to the first joint member 32, and the second and third openings 256, 258 may be positioned below another lateral coupler 17 of the connector 30 that is secured to the second joint member 232. This positioning provides access to the first and second threaded nuts 62, 64 even if the first and second joint members 32, 232 are internal vertical structural members 16 (i.e., facilitates a blind coupling of the first and second joint members 32, 232). Once again, the connector 30 may be devoid of the second openings 56, 256 and the third openings 58, 258.

According to one embodiment, a cross-sectional area of the inner cavity 40 is greater than a cross-sectional area of the fastener 52. This size difference may result in an ease of assembly by increasing the tolerances associated with properly aligning the first joint member 32 and the second joint member 232. If the cross-sectional areas of the inner cavity 40 and the fastener 52 are roughly equal, there is little tolerance available in which the fastener 52 will fit through both the inner cavities 40, 240. As the size of the inner cavities 40, 240 increase relative to the size of the fastener 52, additional tolerance is provided.

However, a gap between the fastener 52 and the tubular inner walls 38, 238 may be undesirable once the first and second joint members 32, 232 are connected as the gap allows lateral movement/shear forces to be imparted on the connector 30. Thus, according to one embodiment, the difference in cross-sectional areas may be large enough to form a gap between the fastener 52 and the tubular inner walls 38, 238 large enough to receive a material therein. According to one embodiment, the material may be a loose, filler material (e.g. gravel).

The tubular inner walls 38, 238 may form a third opening 65, 265 of the inner cavity 40, 240 that is positioned between the first opening 54, 254 of the inner cavity 40, 240 and the second opening 56, 256 of the inner cavity 40, 240 with respect to the first direction D1. The third opening 65, 265 may extend through the tubular inner wall 38, 238 in a direction perpendicular to the first direction D1. The loose, filler material may fill the space between the fastener 52 and the tubular inner walls 38, 238 thereby eliminating the gap and the resultant lateral movement/shear forces.

As shown, the connector 30 may include a third joint member 66 positioned between the first joint member 32 and the second joint member 232 with respect to the first direction D1. The third joint member 66 may include a body 68 (e.g., a plate) and at least one through hole (e.g., a first through hole 70). The body 68 may include opposed planar surfaces that each of the at least one through hole extends through. According to one embodiment, the body 68 may be a monolithic construct.

Figure 6:
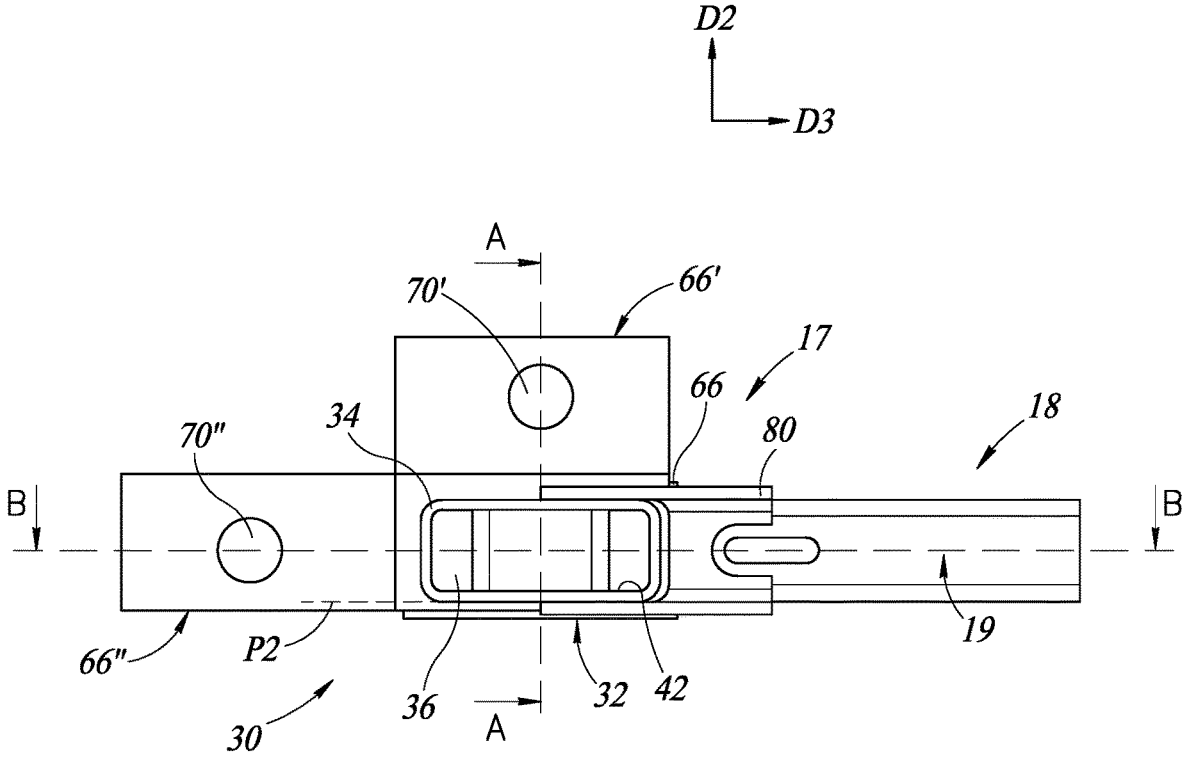
FIG. 6 is a top plan view of the connector illustrated in FIG. 4.
Figure 7:
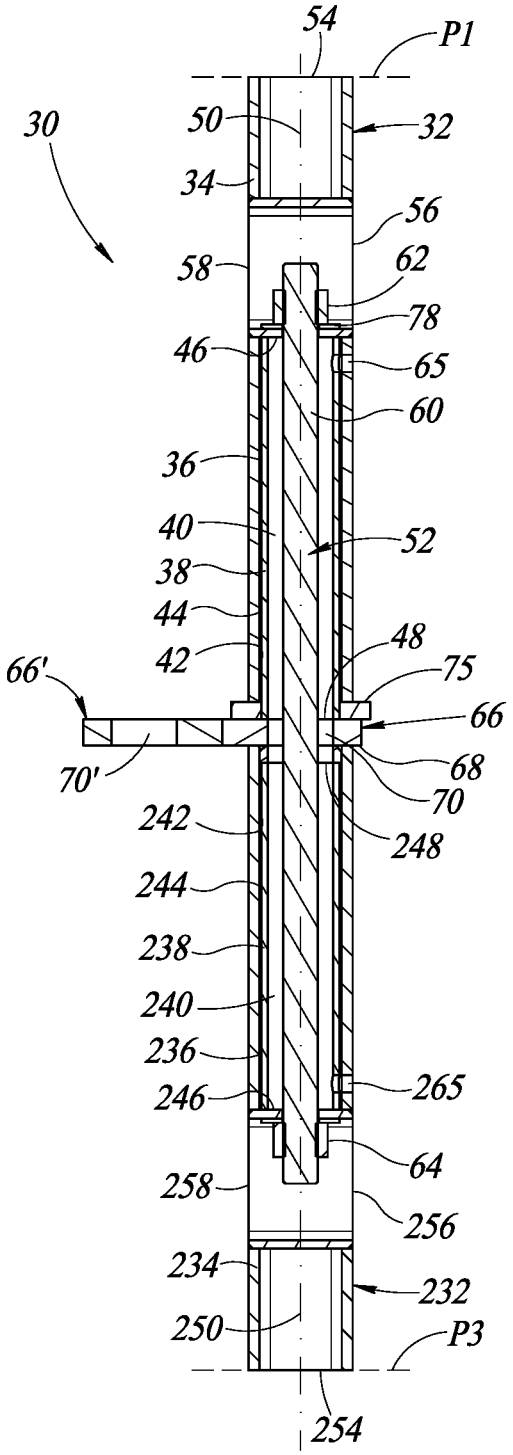
FIG. 7 is a cross-sectional view of the connector illustrated in FIG. 4, along line A-A of FIG. 6.
Figure 8:
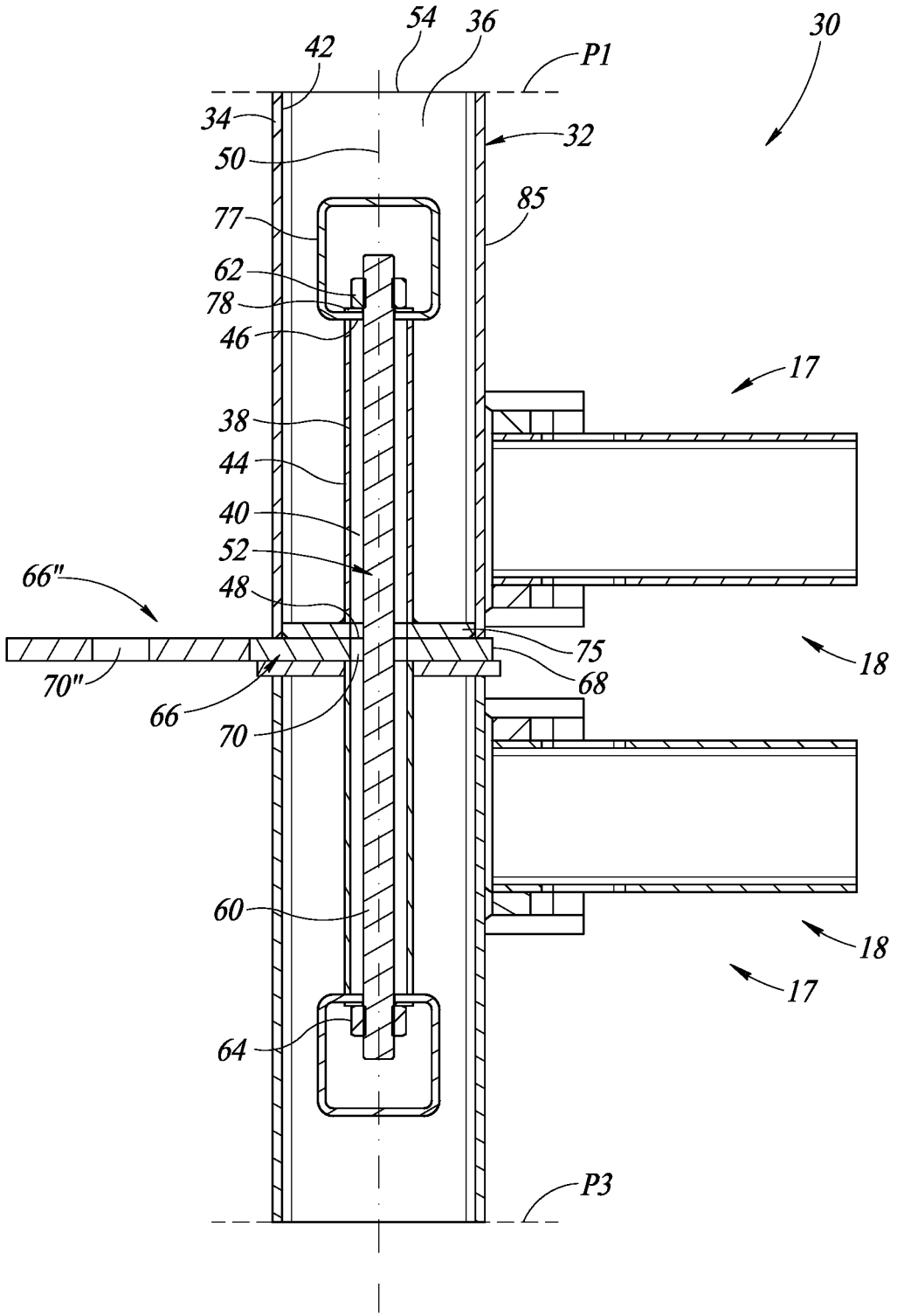
FIG. 8 is a cross-sectional view of the connector illustrated in FIG. 4, along line B-B of FIG. 6.
Figure 9:
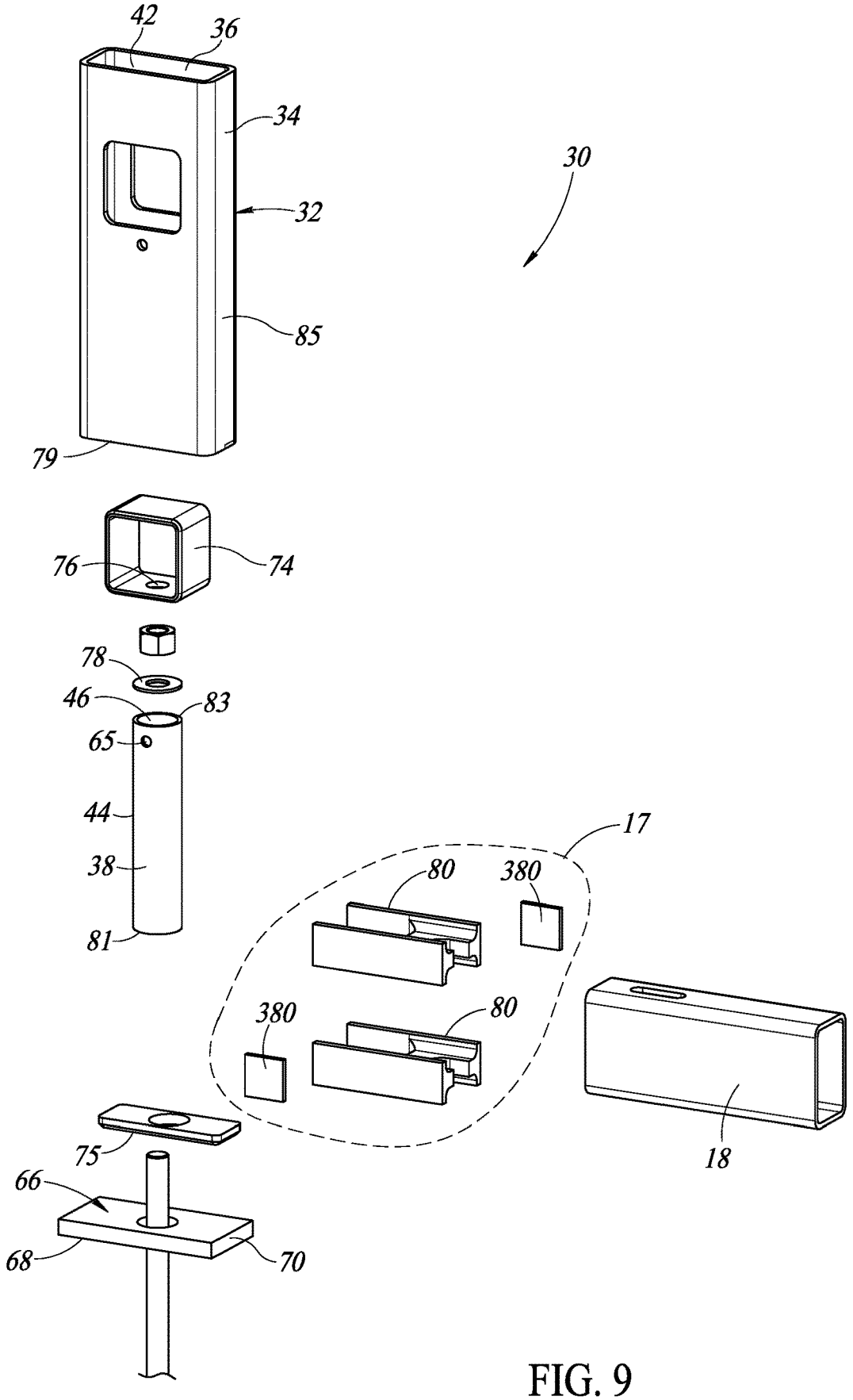
FIG. 9 is an exploded view of a lateral coupler of the connector illustrated in FIG. 4.

According to one embodiment, adjacent ones of the connector 30 may be joined by welding the third joint member 66 of one of the adjacent connectors 30 to a third joint member 66' of the adjacent connector 30 (as shown in FIG. 3). As shown in FIG. 6, the third joint member 66 may be coupled (e.g., welded) to multiple adjacent connectors 30 (e.g., via their respective third joint members 66', 66").

The first through hole 70, 70', 70" of each of the respective third joint member(s) 66, 66', 66" may each be sized to receive at least a portion of a respective one of the fastener 52 (e.g., the threaded rod 60) therethrough. As shown, the first through hole 70' may be spaced from the first through hole 70 in a direction that is perpendicular to the axis 50 and the first direction D1 (e.g., the second direction D2), so as to couple adjacent ones of the connector 30 as described in further detail below. As shown, the first through hole 70" may be spaced from the first through hole 70 in a direction that is perpendicular to the both the first direction D1 and the second direction D2 (e.g., the third direction D3), so as to couple adjacent ones of the connector 30 as described in further detail below.

According to one embodiment, one or more of the third joint members 66, 66', 66" may be devoid of any of the one or more through holes (i.e., the one or more of the third joint members 66, 66', 66" may be a solid plate-like body without any holes). The solid plate-like body may be used to connect embodiments of the first joint member 32 and the second joint member 232 that are devoid of the fastener 52.

The first joint member 32 may include one or more supports 74 that extends from one portion of the inner surface 42 of the tubular outer wall 34 to either another portion of the inner surface 42 of the tubular outer wall 34, the tubular inner wall 38, or both another portion of the inner surface 42 of the tubular outer wall 34 and the tubular inner wall 38. As shown, the one or more supports 74 may span a portion of the outer cavity 36 by connecting to opposite surfaces of the tubular outer wall 34. The connector 30, according to one embodiment, may be devoid of the third joint member 66 such that the first and second joint members 32, 232 are directly coupled (e.g., welded).

According to one embodiment, the one or more supports 74 includes a base support 75 and an intermediate support 77. The base support 75 may be coupled (e.g., welded, glued, fastened, etc.) to a first terminal end 79 of the tubular outer wall 34. The base support 75 may further be coupled (e.g., welded, glued, fastened, etc.) to a first terminal end 81 of the tubular inner wall 38. The base support 75 may be sized to fit within the outer cavity 36, as shown. According to one embodiment, the first joint member 32 or the second joint member 232 may include a base support 275 sized so as not to fit within the outer cavity 36 (e.g., such that a terminal end of the first joint member 32 or the second joint member 232 abuts a major face of the base support 275.

The intermediate support 77 may include an opening 76 that is aligned with the first opening 46 so as to allow the fastener 52 to extend therethrough. According to one embodiment, the intermediate support 77 abuts the tubular inner wall 38 (e.g., a second, or upper, terminal end 83 of the tubular inner wall 38) that forms the first opening 46. Thus, rotation of the first internally threaded nut 62 about the axis 50 may apply compression to the intermediate support 77 either directly or indirectly (e.g., via a spacer 78). According to one embodiment, the intermediate support 77 at least partially corresponds in shape to the second opening 56 of the outer cavity 36. The second joint member 232 may include one or more supports, similar to the one or more supports 74 as described above. The connector 30, according to one embodiment, may be devoid of the intermediate support 77 (e.g., when the connector 30 is not facilitating a blind connection).

The connector 30 may include a lateral coupler 17 that secures one of the horizontal structural members 18 (e.g., an HSS beam) to one of the vertical structural members (e.g., an HSS column, for example the tubular outer wall 34). According to one embodiment, the lateral coupler 17 includes a bracket 80.

Referring to FIGS. 11 to 16, the bracket 80 may include a pair of wings 82 and a bridge 84 that connects the pair of wings 82. The bridge 84 may include a first surface 86 (e.g., an upper surface) and a second surface 88 (e.g., a lower surface) that are opposite one another across a dimension (e.g., a height) of the bridge 84. For example, the first surface 86 and the second surface 88 may be planar surfaces that face in opposite vectors (e.g., up and down) of the first direction D1. The bridge 84 may define a height H1 measured from the first surface 86 to the second surface 88 along the first direction D1. According to one embodiment, the height H1 may be between 1 inch and 3 inches, for example 1.5 inches.

The bridge 84 may further include a front edge 90 and a rear edge 92 that are opposite one another. For example, the front edge 90 and the rear edge 92 may be planar surfaces that face in opposite vectors of the third direction D3. The bridge 84 may define a depth J1 measured from the front edge 90 to the rear edge 92 along the third direction D3. According to one embodiment, the depth J1 (e.g., a maximum value for the depth J1) may be between 4 inches and 8 inches, for example 6 inches. As shown the bracket 80 may include a recess 94 that extends into the bridge 84 toward the rear edge 92 between the pair of wings 82. Thus, portions of the bridge 84 (e.g., where the recess 94 is located) may have a reduced depth J1 compared to portions of the bridge 84 spaced away from the recess 94. As shown, at least a portion of the recess 94 may have a curved shape (e.g., formed by a concave portion 96 of the front edge 90).

The pair of wings 82 may include a first wing 300 and a second wing 302. As shown the first wing 300 and the second wing 302 may be identical to one another, such that any description herein of the first wing 300 is applicable to the second wing 302. According to one embodiment, the first wing 300 and the second wing 302 may have differences in their structure (e.g., dimensions).

The bracket 80 (e.g., the bridge 84) may have a width W1 measured from the first wing 300 to the second wing 302 along the second direction D2. According to one embodiment, the width W1 may be between 4 inches and 8 inches, for example 6 inches.

The first wing 300 may include an inner surface 304 and an outer surface 306 that are opposite one another across a dimension (e.g., a width). For example, the inner surface 304 and the outer surface 306 may be planar surfaces that face in opposite vectors of the second direction D2. As shown, portions of the inner surface 304 may face toward (e.g., be coupled directly to) the bridge 84 and portions of the inner surface 304 may face toward the second wing 302. The outer surface 306 may face away from the bridge 84 and the second wing 302. The first wing 300 may define a width W2 measured from the inner surface 304 to the outer surface 306 (e.g., along the second direction D2). According to one embodiment, the width W2 may be between 0.5 inches and 2 inches, for example 0.75 inches.

The first wing 300 may further include a front edge 310 and a rear edge 312 that are opposite one another across a dimension (e.g., a depth). For example, the front edge 310 and the rear edge 312 may be planar surfaces that face in opposite vectors of the third direction D3. The first wing 300 may define a depth J2 measured from the front edge 310 to the rear edge 312 along the third direction D3. According to one embodiment, the depth J2 may be greater than (e.g., at least twice) the depth J1 of the bridge 84. The depth J2 of the first wing 300 may be between 8 inches and 16 inches, for example 13.5 inches.

According to one embodiment, at least a portion of the front edge 90 of the bridge 84 and the front edge 310 of the first wing 300 may be flush as shown in the illustrated embodiment. According to one embodiment, an entirety of the front edge 90 of the bridge 84 and the front edge 310 of the first wing 300 may be offset. According to one embodiment, the rear edge 92 of the bridge 84 and the rear edge 312 of the first wing 300 may be offset as shown in the illustrated embodiment.

The first wing 300 may further include an upper edge 314 and a lower edge 316 that are opposite one another across a dimension (e.g., the height). For example, the upper edge 314 and the lower edge 316 may be planar surfaces that face in opposite vectors of the first direction D1. The first wing 300 may define a height H2 measured from the upper edge 314 to the lower edge 316 along the first direction D1. According to one embodiment, the height H2 may be greater than (e.g., at least twice) the height H1 of the bridge 84. The height H2 of the first wing 300 may be between 2 inches and 6 inches, for example 4 inches.

According to one embodiment, the bridge 84 may extend between and connect the first wing 300 to the second wing 302 such that the first surface 86 and the second surface 88 are between the upper edge 314 and the lower edge 316. According to one embodiment, the bridge 84 may be positioned equidistant from the upper edge 314 and the lower edge 316 (i.e., such that a midplane 318 of the bridge 84, with respect to the height, is coplanar with a midplane 319 of the first wing 300, with respect to the height).

Figure 10:
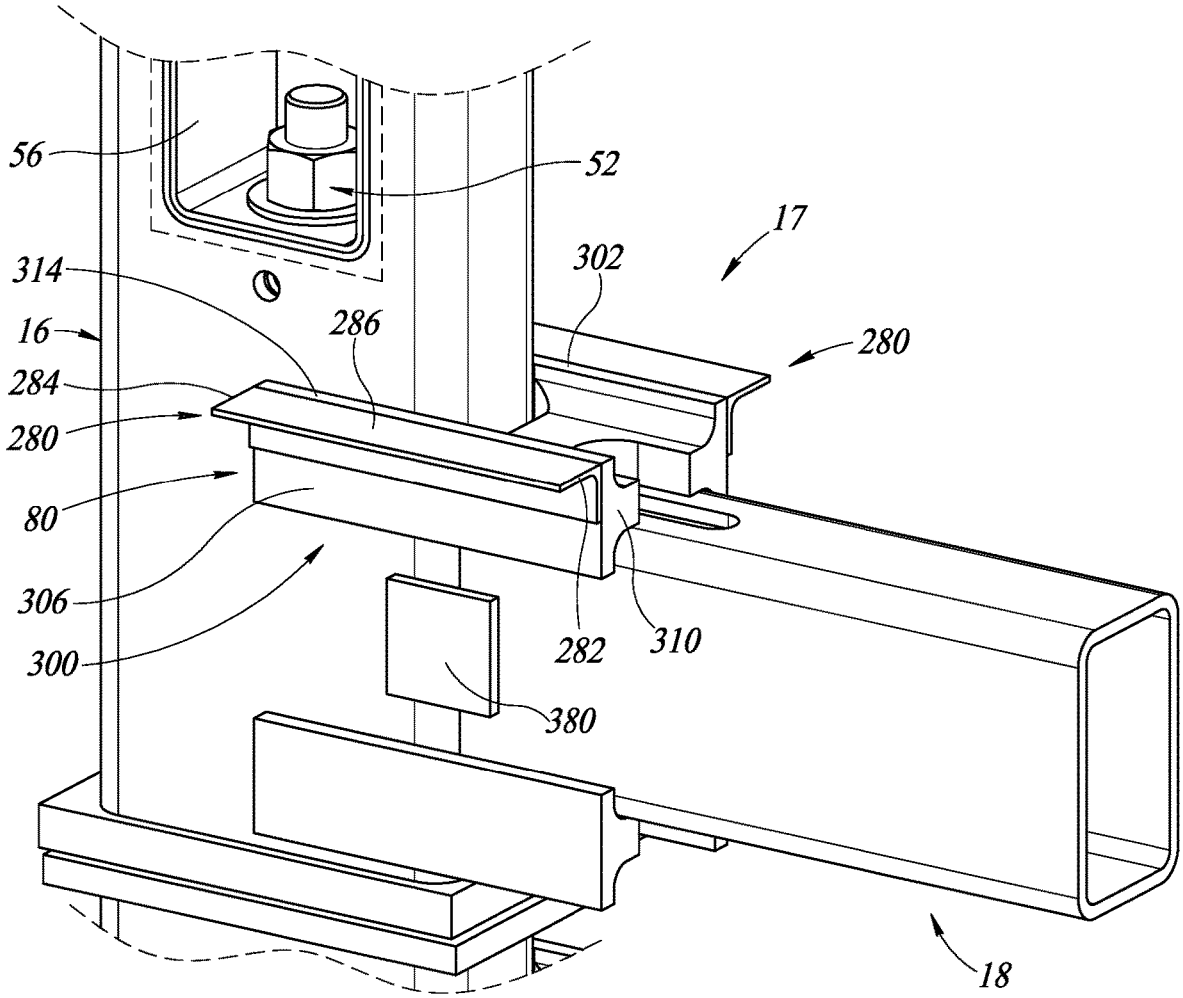
FIG. 10 is an isometric view of a connector, according to one embodiment.
Figure 11:
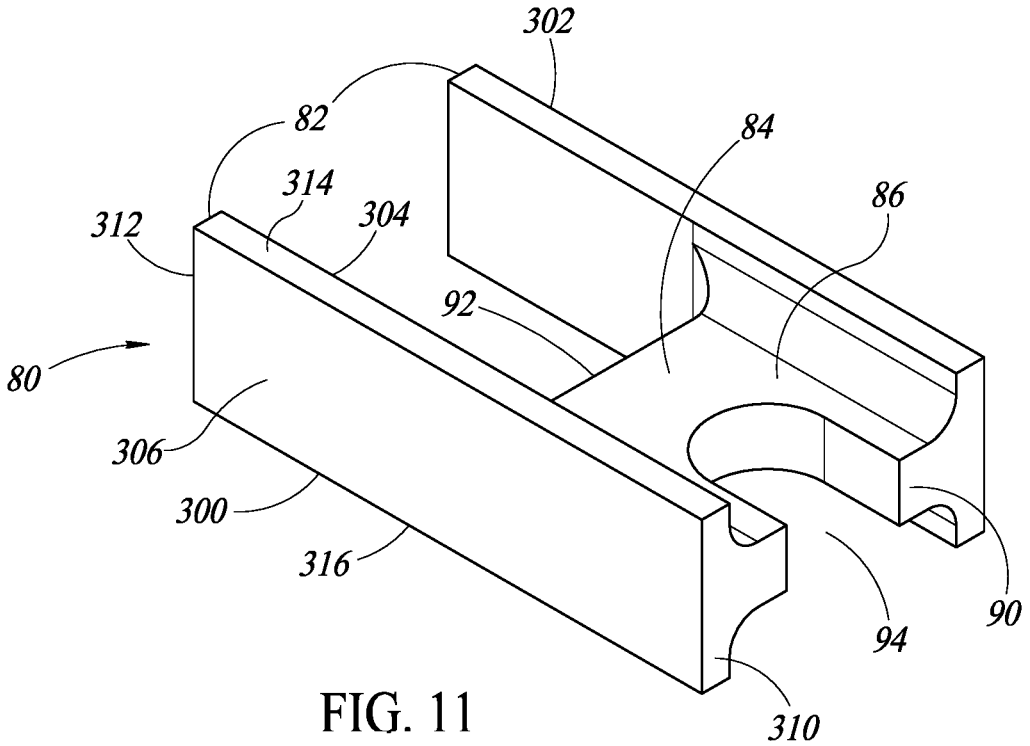
FIG. 11 is a top, front isometric view of a bracket of the lateral coupler illustrated in FIG. 9.
Figure 12:
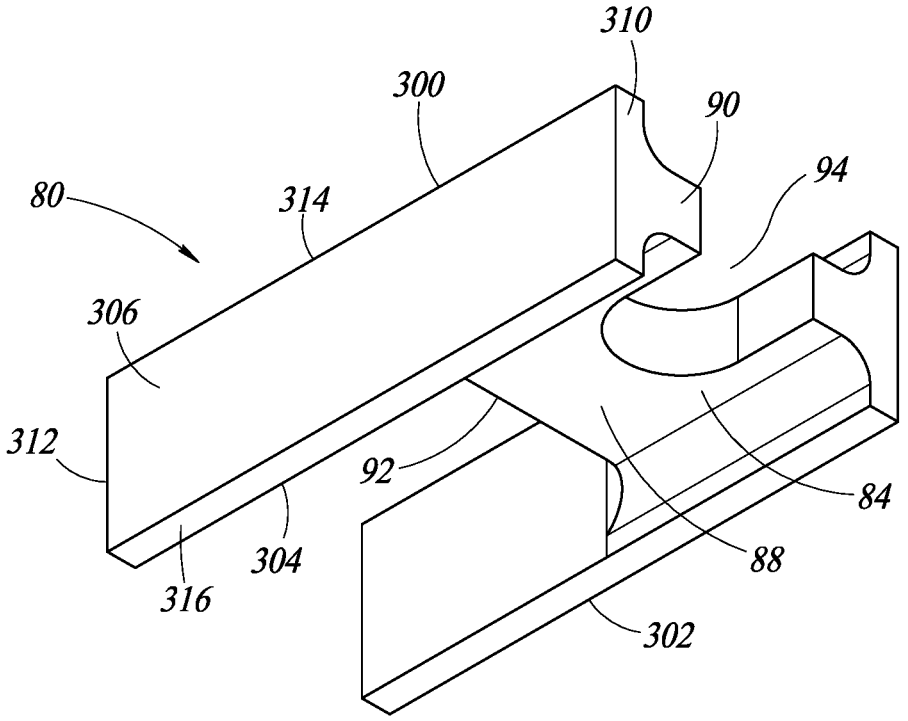
FIG. 12 is a bottom, front isometric view of the bracket illustrated in FIG. 11.
Figure 13:
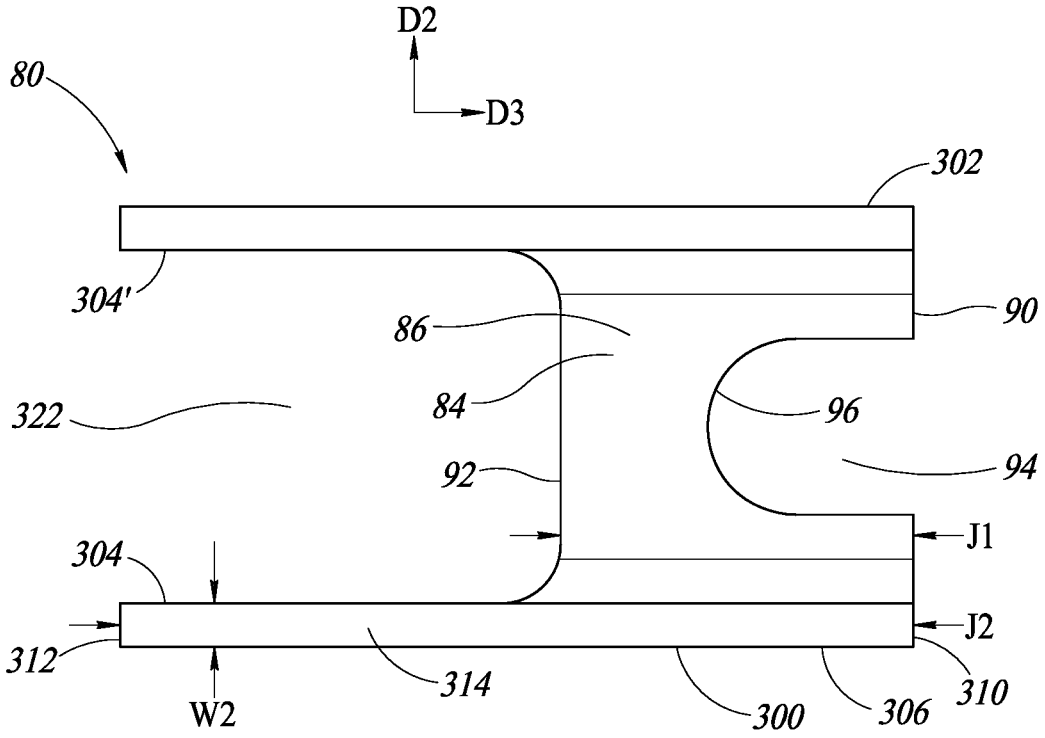
FIG. 13 is a top plan view of the bracket illustrated in FIG. 11.
Figure 14:
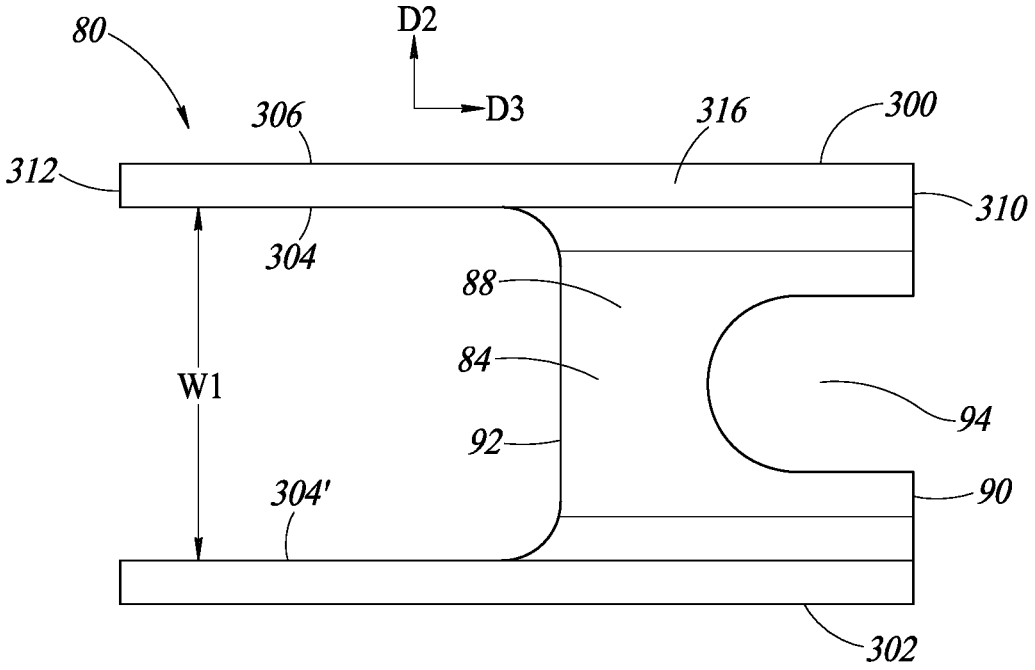
FIG. 14 is a bottom plan view of the bracket illustrated in FIG. 11.
Figure 15:
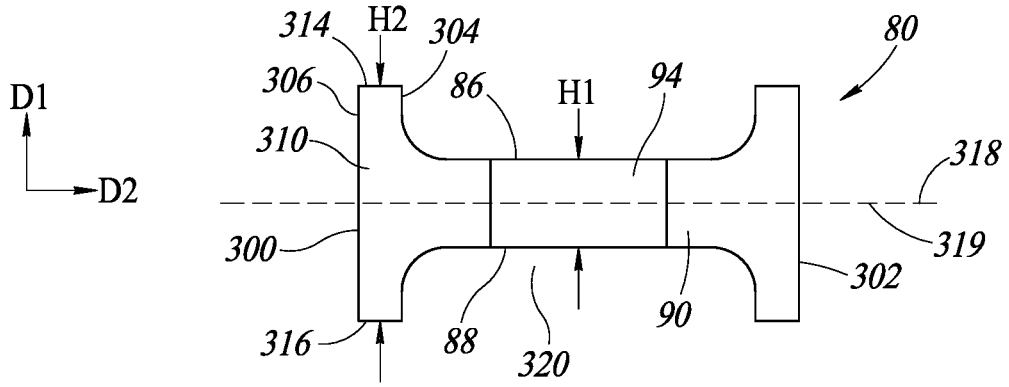
FIG. 15 is a front elevation view of the bracket illustrated in FIG. 11.
Figure 16:
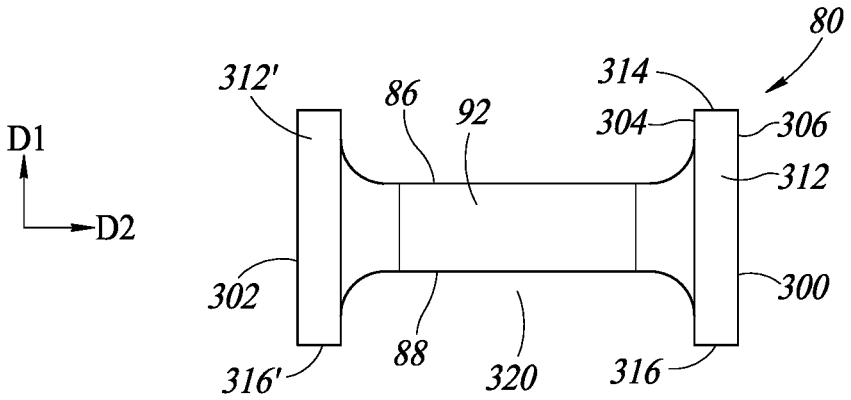
FIG. 16 is a rear elevation view of the bracket illustrated in FIG. 11.
Figure 17:
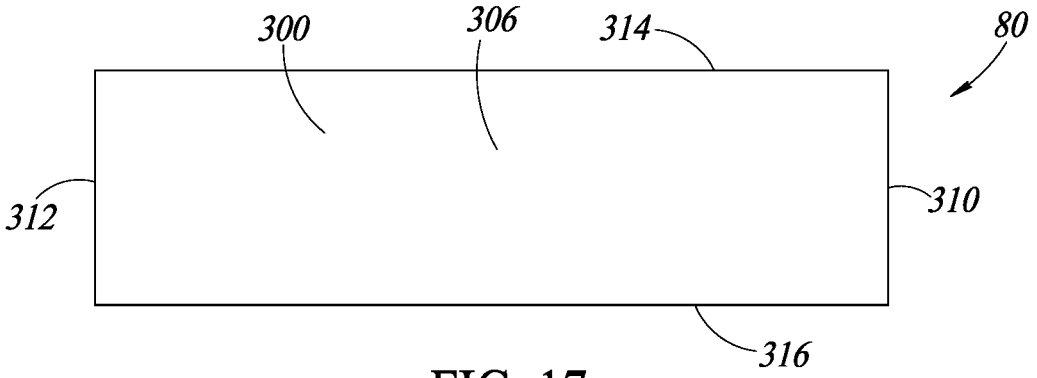
FIG. 17 is a side elevation view of the bracket illustrated in FIG. 11.
Figure 18:
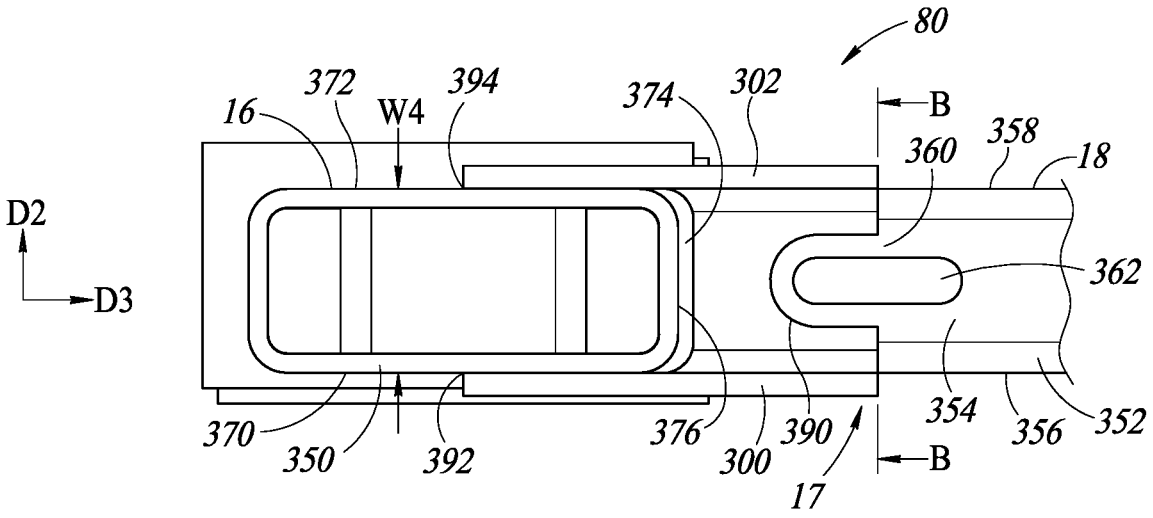
FIG. 18 is a top plan view of the lateral coupler illustrated in FIG. 9 in use coupling a vertical structural member and a horizontal structural member.
Figure 19:
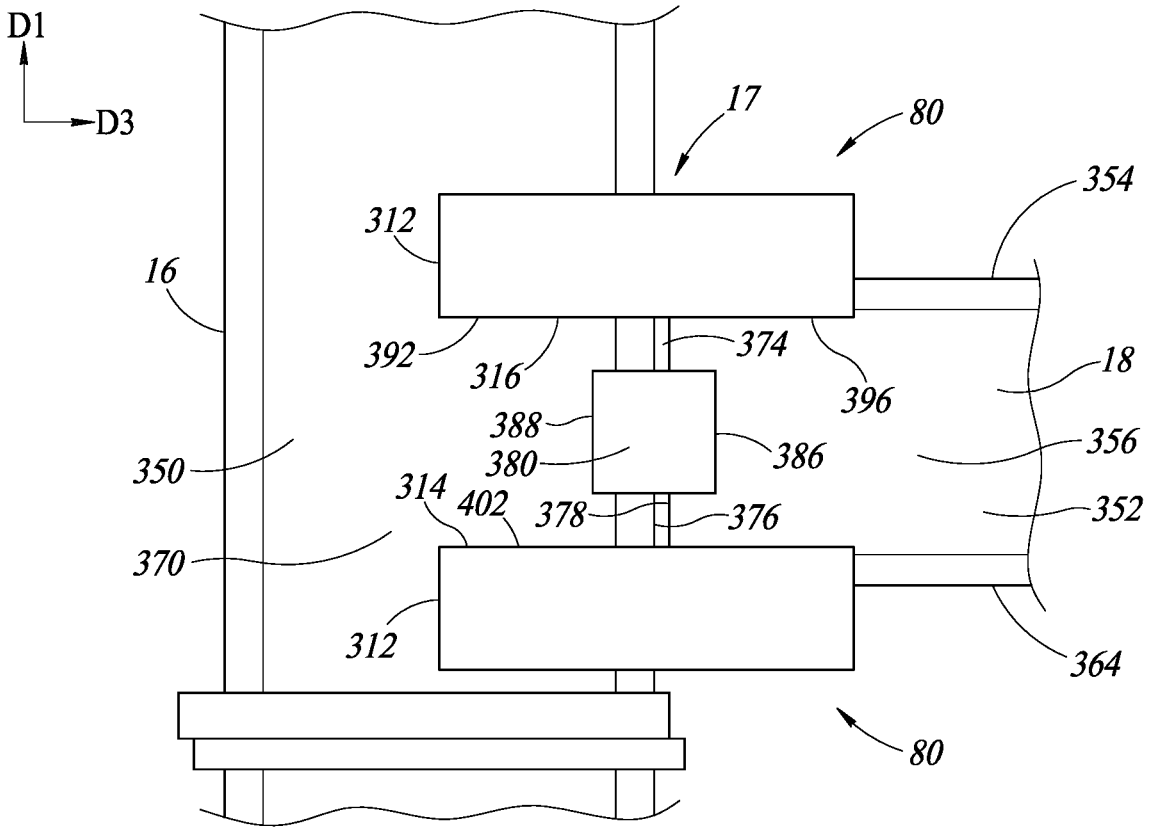
FIG. 19 is a side elevation view of the lateral coupler in use coupling the vertical structural member and the horizontal structural member illustrated in FIG. 18.
Figure 20:
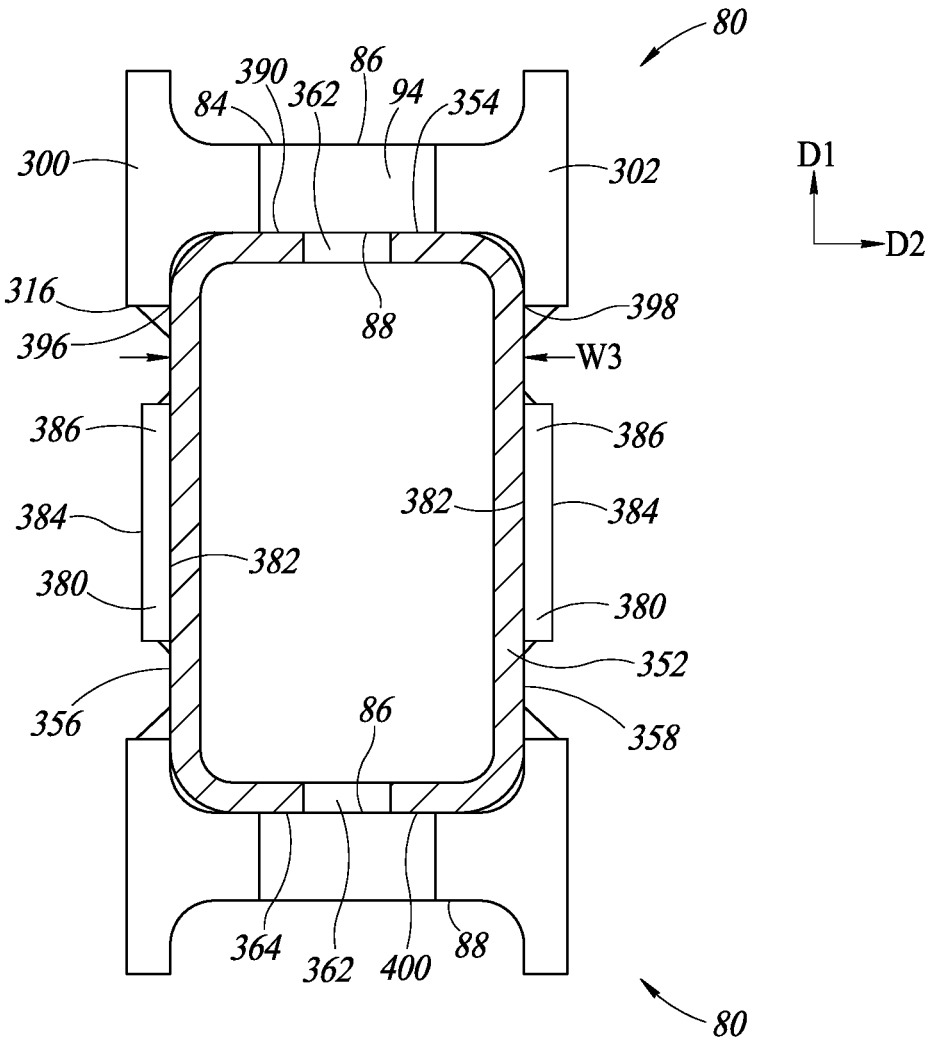
FIG. 20 is a cross-sectional view of the lateral coupler secured to the horizontal structural member illustrated in FIG. 18, along line B-B.

Referring to FIG. 10, the lateral coupler 17 may include one or more angle brackets 280 (e.g., carried by the bracket 80). As shown, the lateral coupler 17 may include one of the angle brackets 280 directly coupled to the outer surface 306 of the first wing 300. The angle bracket 280 may have a depth equal to or less than the depth J2 of the first wing 300. As shown, the angle bracket 280 may be positioned with respect to the first wing 300 such that a front edge 282 of the angle bracket 280 is flush with the front edge 310 of the first wing 300, a rear edge 284 of the angle bracket 280 is flush with the rear edge 312 of the first wing 300, and an upper surface 286 of the angle bracket 280 is flush with the upper edge 314 of the first wing 300. The one or more angle brackets 280 may include a second angle bracket 280 directly coupled to the second wing 302 (e.g., positioned similarly to how the angle bracket 280 is positioned relative to the first wing 300 as described above).

Referring to FIGS. 11 to 20, the bracket 80 may couple the vertical structural member 16 (e.g., an HSS column 350) to the horizontal structural member 18 (e.g., an HSS beam 352) as described below. The second surface 88 of the bridge 84 may abut a surface (e.g., an upper surface 354 that is planar and normal to the first direction D1) of the HSS beam 352). The bracket 80 may be manufactured and/or provided such that the width W1 of the bracket 80 corresponds to a width W3 of the HSS beam 352. As shown, the width W3 of the HSS beam 352 may be measured from a first outer surface 356 of the HSS beam 352 to a second outer surface 358 of the HSS beam 352 (e.g., along the second direction D2).

According to one embodiment, the width W1 of the bracket 80 may correspond to the width W3 such that a portion of the HSS beam 352 is receivable within a recess 320 that is partially delineated by the bridge 84 (e.g., the second surface 88 of the bridge 84) and by the inner surfaces 304 of the first wing 300 and the second wing 302. The recess 320 may alternatively or additionally (i.e., a second recess) be partially delineated by the first surface 86 of the bridge 84 and by the inner surfaces 304 of the first wing 300 and the second wing 302. The portion of the HSS beam 352 may be receivable within the recess 320 such that the inner surfaces 304 of the first wing 300 and the second wing 302 contact the first outer surface 356 and second outer surface 358 of the HSS beam 352, respectively. According to one embodiment, the portion of the HSS beam 352 may be receivable within the recess 320 such that the inner surfaces 304 of the first wing 300 and the second wing 302 are in close proximity to the first outer surface 356 and second outer surface 358 of the HSS beam 352, respectively, such that the bracket 80 is securable to the HSS beam 352 by welding (e.g., welding portions of the lower edges 316 of the first wing 300 and the second wing 302 to the first outer surface 356 and second outer surface 358 of the HSS beam 352, respectively), fastening, adhesive, or other known attachment mechanisms.

The HSS beam 352 may include a weakened portion 360 that influences a location for failure of the HSS beam 352 in response to a failure event. According to one embodiment, the weakened portion 360 may include a hole 362 that extends through at least one outer surface of the HSS beam 352. As shown, the weakened portion 360 may include one of the holes 362 in the upper surface 354, and another one of the holes 362 in a lower surface 364, which is opposite the upper surface 354 across a dimension (e.g., the height), and planar and normal to the first direction D1, of the HSS beam 352. The holes 362 may be identical (e.g., having a same size and shape), or they may be different from one another. The holes 362 may be aligned (e.g., along the first direction D1 as shown), or offset from one another.

The bracket 80 may be securable to the HSS beam 352 such that the recess 94 is aligned with the hole 362. As shown, the recess 94 is larger than the hole 362 such that a first interface 390 (e.g., an intersection) of the portion of the front edge 90 that forms the recess 94 and the upper surface 354 such that the portion of the front edge 90 that forms the recess 94 and the upper surface 354 may be welded together.

According to one embodiment, the width W1 of the bracket 80 may correspond to a width W4 of the HSS column 350. As shown, the width W4 of the HSS column 350 may be measured from a first outer surface 370 of the HSS column 350 to a second outer surface 372 of the HSS column 350 (e.g., along the second direction D2). A portion of the HSS column 350 may be receivable within a recess 322 that is partially delineated by the bridge 84 (e.g., the rear edge 92 of the bridge 84) and by the inner surfaces 304 of the first wing 300 and the second wing 302.

The portion of the HSS column 350 may be receivable within the recess 322 such that the inner surfaces 304 of the first wing 300 and the second wing 302 contact the first outer surface 370 and second outer surface 372 of the HSS column 350, respectively. According to one embodiment, the portion of the HSS column 350 may be receivable within the recess 322 such that the inner surfaces 304 of the first wing 300 and the second wing 302 are in close proximity to the first outer surface 370 and second outer surface 372 of the HSS column 350, respectively, such that the bracket 80 is securable to the HSS column 350 by welding (e.g., welding portions of the lower edges 316 of the first wing 300 and the second wing 302 to the first outer surface 370 and second outer surface 372 of the HSS column 350, respectively).

The bracket 80 (e.g., the depth J2 of the first wing 300 and the second wing 302) may be selected such that the recess 322 receives no more than half of a depth of the HSS column 350 such that another bracket 80 is attachable to the opposite side (across the depth) of the HSS column 350 in a mirrored arrangement.

According to one embodiment, the bracket 80 may couple the HSS column 350 to the HSS beam 352 such that there is no direct contact of the HSS column 350 and the HSS beam 352. As shown, a gap 374 may be formed and maintained between the HSS column 350 and the HSS beam 352 (e.g., between a surface 376 of the HSS column 350 that faces the HSS beam 352 and a terminal edge 378 of the HSS beam 352 that faces the HSS column 350). The gap 374 facilitates control of the location of a failure, by limiting transfer of forces to the HSS column 350. According to one embodiment, the gap 374 is between 0.25 inches and 1 inch (e.g., 0.5 inches).

According to one embodiment, the lateral coupler 17 may include a plurality of the brackets 80. As shown, one of the brackets 80 may be secured to the upper surface 354 of the HSS beam 352, and another one of the brackets 80 may be secured to the lower surface 364 of the HSS beam 352.

The lateral coupler 17 may further include one or more auxiliary brackets 380 that further secure the HSS column 350 to the HSS beam 352. According to one embodiment, the auxiliary bracket 380 may be in the form of a plate with an inner planar surface 382 and an outer planar surface 384. The auxiliary bracket 380 may be positioned between first and second ones of the brackets 80, and secured to both the HSS column 350 and the HSS beam 352 while maintaining the gap 374.

According to one embodiment, the inner planar surface 382 may abut both the first outer surface 356 of the HSS beam 352 and the first outer surface 370 of the HSS column 350. A front edge 386 of the auxiliary bracket 380 that extends between the inner planar surface 382 and the outer planar surface 384 may be welded to the first outer surface 356 to secure the auxiliary bracket 380 to the HSS beam 352, and a rear edge 388 of the auxiliary bracket 380 that extends between the inner planar surface 382 and the outer planar surface 384 and is opposite the front edge 386 across a dimension (e.g., the depth). The rear edge 388 may be welded to the first outer surface 370 to secure the auxiliary bracket 380 to the HSS column 350.

The lateral coupler 17 may include another auxiliary bracket 380 similarly positioned and secured to the second outer surface 358 of the HSS beam 352 and the second outer surface 372 of the HSS column 350.

The lateral coupler 17 may be designed such that in the event of a catastrophic failure, the HSS beam 352 fails first (e.g., due to the position of the weakened portion 360 and the bracket 80), resulting in the HSS column 350 remaining largely intact, limiting a total collapse of the modular structure 10. According to one embodiment, a weak point (i.e., the location at which plastic deformation is most likely to occur during a failure event) is formed in the HSS beam 352, and specifically, at a portion of the HSS beam 352 the includes the weakened portion 360 located further from the HSS column 350 than the front edges 90, 310 of the bracket 80 when the bracket 80 is secured to both the HSS column 350 and the HSS beam 352.

A method of securing the vertical structural member 16 to the horizontal structural member 18 to form a joint. The method may include abutting a surface (e.g., the second surface 88) of the bridge 84 of the bracket 80 with a surface (e.g., the upper surface 354) of the horizontal structural member 18 such that the recess 94 of the bracket 80 is aligned with the hole 362 in the upper surface 354 thereby forming a first interface 390 between the second surface 88 of the bridge 84 and the upper surface 354 of the horizontal structural member 18.

The method may include securing the bracket 80 to the horizontal structural member 18 by welding along at least a portion of the first interface 390. According to one embodiment, the method may include abutting the inner surface 304 of the first wing 300 of the bracket 80 with the first outer surface 370 of the vertical structural member 16 thereby forming a second interface 392 between the first wing 300 (e.g., the lower edge 316, the rear edge 312, or both) and the and the first outer surface 370 of the vertical structural member 16. As shown, the first inner surface 304 may be perpendicular to the second surface 88 of the bridge 84.

The method may include abutting the inner surface 304' of the second wing 302 of the bracket 80 with the second outer surface 372 of the vertical structural member 16 thereby forming a third interface 394 between the second wing 302 (e.g., the lower edge 316', the rear edge 312', or both) and the second outer surface 372 of the vertical structural member 16. As shown the inner surface 304' of the second wing 302 may be parallel to the inner surface 304 of the first wing 300, and the second outer surface 372 may be parallel to the first outer surface 370.

The method may include securing the bracket 80 to the vertical structural member 16 by welding along at least a portion of the second interface 392 and by welding along at least a portion of the third interface 394. Abutting the second surface 88 of the bridge 84 with the upper surface 354 of the horizontal structural member 18 may form a fourth interface 396 between the first wing 300 (e.g., the lower edge 316) and the first outer surface 356 of the horizontal structural member 18. The method may include securing the bracket 80 to the horizontal structural member 18 by welding along at least a portion of the fourth interface 396. As shown, the first outer surface 356 of the horizontal structural member 18 may be coplanar with the first outer surface 370 of the vertical structural member 16.

Abutting the second surface 88 of the bridge 84 with the upper surface 354 of the horizontal structural member 18 may form a fifth interface 398 between the second wing 302 (e.g., the lower edge 316') and the second outer surface 358 of the horizontal structural member 18. The method may include securing the bracket 80 to the horizontal structural member 18 by welding along at least a portion of the fifth interface 398. As shown, the second outer surface 358 of the horizontal structural member 18 may be coplanar with the second outer surface 372 of the vertical structural member 16.

The method may further include using another of the bracket 80 similarly as described above, but inverted. For example, the method may include abutting the first surface 86 of the bridge 84 of the second bracket 80 with the lower surface 364 of the horizontal structural member 18 such that the recess 94 of the second bracket 80 is aligned with the hole 362 in the lower surface 364 thereby forming a sixth interface 400 between the first surface 86 of the bridge 84 and the lower surface 364 of the horizontal structural member 18. Securing the second bracket 80 to the horizontal structural member 18 may include welding along at least a portion of the sixth interface 400.

The method may include abutting the inner surface 304 of the first wing 300 of the second bracket 80 with the first outer surface 370 of the vertical structural member 16 thereby forming a seventh interface 402 between the first wing 300 (e.g., the upper edge 314, the rear edge 312, or both) of the second bracket 80 and the first outer surface 370 of the vertical structural member 16. The method may include abutting the inner surface 304' of the second wing 302 of the second bracket 80 with the second outer surface 372 of the vertical structural member 16 thereby forming an eighth interface (not shown, opposite the seventh interface 402) between the second wing 302 of the second bracket 80 and the second outer surface 372 of the vertical structural member 16. The method may include securing the second bracket 80 to the vertical structural member 16 by welding along at least a portion of the seventh interface 402 and by welding along at least a portion of the eighth interface.

The method may include abutting the inner surface 382 of the auxiliary bracket 380 with both the first outer surface 370 and the first outer surface 356, securing the auxiliary bracket 380 to the horizontal structural member 18 by welding the front edge 386 to the first outer surface 356, and securing the auxiliary bracket 380 to the vertical structural member 16 by welding the rear edge 388 to the first outer surface 370. The method may include the use of a second auxiliary bracket 380 attached and secured (e.g., welded) to the second outer surface 358 and the second outer surface 372.

According to one embodiment, the method is performed while maintaining the gap 374 between the vertical structural member 16 and the horizontal structural member 18 (e.g., before, during, and after securing the bracket 80 to the horizontal structural member 18 and securing the bracket 80 to the vertical structural member 16).

Referring to FIGS. 4 to 10, according to one embodiment, a method of securing a plurality of structural section members (e.g., one or more of the horizontal structural member 18 to one or more of the vertical structural member 16) includes securing a first vertical structural member 16 (e.g., a hollow structural section column) to the tubular outer wall 34 of the first joint member 32. The method may further include securing a second vertical structural member 16 (e.g., a hollow structural section column) to the tubular outer wall 234 of the second joint member 232. The method may further include positioning a first portion of the 52 fastener within the inner cavity 40 of the first joint member 32 and positioning a second portion of the fastener 52 within the inner cavity 240 of the second joint member 232 such that the fastener simultaneously extends through: the first opening 46, the second opening 248, the first opening 246, and the second opening 248.

The method may further include accessing the fastener 52 through the second opening 56 formed by the tubular outer wall 34 of the first joint member 32, and while accessing the fastener 52 through the second opening 56, actuating the fastener 52 thereby applying compression to both the first joint member 32 and the second joint member 232. According to one embodiment, actuating the fastener may include rotating the internally threaded nut 62 relative to the externally threaded rod 60 about the axis 50, thereby translating the internally threaded nut 62 relative to the externally threaded rod 60 via engagement of corresponding threads.

The method may further include accessing the fastener 52 through the 256 opening formed by the tubular outer wall 234 of the second joint member 232, and accessing the fastener 52 through the second opening 256. According to one embodiment, actuating the fastener 52 includes rotating at least one of the first internally threaded nut 62 and the second internally threaded nut 64 of the fastener 52 relative to the externally threaded rod 60 about the axis 50, thereby translating the at least one of the first internally threaded nut 62 and the second internally threaded nut 64 relative to the externally threaded rod 60 via engagement of corresponding threads.

The method may further include filling at least a portion of the inner cavity 40 of the first joint member 32 between the first portion of the fastener 52 and the tubular inner wall 38 of the first joint member 32 with a material (e.g., gravel). The method may further include filling at least a portion of the inner cavity 240 of the second joint member 232 between the second portion of the fastener 52 and the tubular inner wall 238 of the second joint member with the material.

The method may include filling at least a portion of the inner cavity 40 of the first joint member 32 with the material by inserting the material through a pipe 69 that extends from the tubular outer wall 34 of the first joint member 32 to the tubular inner wall 38 of the first joint member 32 thereby forming a path from an exterior of the first joint member 32 to the inner cavity 40 of the first joint member 32. According to one embodiment, the pipe 69 may be attached to the tubular inner wall 38 at a location between the first opening 46 and the second opening 48.

The above description of illustrated embodiments, including what is described in the Abstract, is not intended to be exhaustive or to limit the embodiments to the precise forms disclosed. Although specific embodiments of and examples are described herein for illustrative purposes, various equivalent modifications can be made without departing from the spirit and scope of the disclosure, as will be recognized by those skilled in the relevant art.

Many of the methods described herein can be performed with variations. For example, many of the methods may include additional acts, omit some acts, and/or perform acts in a different order than as illustrated or described.

The various embodiments described above can be combined to provide further embodiments. To the extent that they are not inconsistent with the specific teachings and definitions herein, all of the U.S. patents, U.S. patent application publications, U.S. patent applications, foreign patents, foreign patent applications and non-patent publications referred to in this specification and/or listed in the Application Data Sheet, including but not limited to U.S. Provisional Application No. 62/929,698, filed Nov. 1, 2019; PCT Application No. PCT/US2019/030465; and U.S. Provisional Application No. 63/218,227, filed Jul. 2, 2021, are incorporated herein by reference, in their entirety. Aspects of the embodiments can be modified, if necessary, to employ systems, circuits and concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A bracket comprising:

a first wing having a first inner surface and a first outer surface that is opposite the first inner surface;

a second wing having a second inner surface and a second outer surface that is opposite the second inner surface; and a bridge that extends from the first inner surface to the second inner surface thereby coupling the first wing to the second wing such that: 1) the first inner surface is normal to a first direction, and 2) the first inner surface is parallel to the second inner surface, the bridge including a front edge and a rear edge opposite the front edge, the front edge forming a recess that extends into the bridge towards the rear edge along a second direction that is perpendicular to the first direction, wherein the recess terminates within the bridge prior to reaching the rear edge, wherein the front edge is a first front edge, the rear edge is a first rear edge, the first wing includes a second front edge and a second rear edge opposite the second front edge, at least a portion of the first front edge is coplanar with the second front edge, and an entirety of the first rear edge is offset from the second rear edge, wherein the bridge has a first depth measured from the first front edge to the first rear edge along the second direction, the first wing has a second depth measured from the second front edge to the second rear edge along the second direction, and the second depth is greater than the first depth, wherein the first depth varies as measured at different locations between the first wing and the second wing, wherein the first depth has a maximum value at a location where the bridge intersects the first wing, the first depth has a minimum value at a location where the recess is closest to the rear edge, and wherein the minimum value of the first depth is located halfway between the first wing and the second wing.

2. The bracket of claim 1 wherein the maximum value of the first depth is at least two times greater the minimum value of the first depth.

3. The bracket of claim 1 wherein the second depth is at least two times greater than the maximum value of the first depth.

4. The bracket of claim 1 wherein the bridge includes an upper surface and a lower surface that is opposite the upper surface, the bridge has a first height measured from the upper surface to the lower surface along a third direction that is perpendicular to both the first direction and the second direction, the first wing includes an upper edge and a lower edge that is opposite the upper edge, the first wing has a second height measured from the upper edge to the lower edge along the third direction, and the second height is greater than the first height, a midplane of the bridge is coplanar with a midplane of the first wing, and the bracket is symmetrical about the midplane of the bridge.

5. The bracket of claim 4 wherein the upper surface and the lower surface are both planar surfaces that are normal to the third direction.

6. The bracket of claim 1 wherein the bridge has a first width measured from the first inner surface to the second inner surface along the first direction, the first wing has a second width measured from the first inner surface to the first outer surface along the first direction, the first width is greater than the second width, and the first width is more than four times the second width.

7. The bracket of claim 1 wherein the second wing is identical to the first wing.

8. A hollow structural section joint comprising:

a first hollow structural section;

a second hollow structural section; and a bracket secured to both the first hollow structural section and the second hollow structural section, the bracket comprising:

a first wing having a first inner surface and a first outer surface that is opposite the first inner surface;

a second wing having a second inner surface and a second outer surface that is opposite the second inner surface; and a bridge that extends from the first inner surface to the second inner surface thereby coupling the first wing to the second wing such that: 1) the first inner surface is normal to a first direction, and 2) the first inner surface is parallel to the second inner surface, the bridge including a front edge and a rear edge opposite the front edge, the front edge forming a recess that extends into the bridge towards the rear edge along a second direction that is perpendicular to the first direction, wherein the recess terminates within the bridge prior to reaching the rear edge;

a first angle bracket secured to the first outer surface of the first wing; and a second angle bracket secured to the second outer surface of the second wing.

9. The hollow structural section joint of claim 8 wherein the bridge is welded to a surface of the first hollow structural section, the first wing is welded to a surface of the second hollow structural section, the surface of the first hollow structural section is perpendicular to the surface of the second hollow structural section; and the surface of the second hollow structural section is a first surface of the second hollow structural section, the second wing is welded to a second surface of the second hollow structural section, and the first surface of the second hollow structural section is parallel to the second surface of the second hollow structural section.

10. The hollow structural section joint of claim 8 wherein the first hollow structural section is elongate along a first central axis, the second hollow structural section is elongate along a second central axis, the bracket is secured to both the first hollow structural section and the second hollow structural section such that the first central axis is perpendicular to the second central axis, and the bracket is secured to both the first hollow structural section and the second hollow structural section such that the first central axis intersects the second central axis.

11. The hollow structural section joint of claim 8 wherein the bracket is a first bracket, the hollow structural section joint further comprising:

a second bracket secured to both the first hollow structural section and the second hollow structural section.

12. The hollow structural section joint of claim 11 wherein:

the bridge of the first bracket is welded to an upper surface of the first hollow structural section;

the first wing of the first bracket is welded to a first outer surface of the second hollow structural section;

the bridge of the second bracket is welded to a lower surface of the first hollow structural section that is parallel and opposite the upper surface;

the first wing of the second bracket is welded to the first outer surface of the second hollow structural section;

the upper surface of the first hollow structural section is perpendicular to the first outer surface of the second hollow structural section;

the second wing of the first bracket is welded to a second outer surface of the second hollow structural section;

the second wing of the second bracket is welded to the second outer surface of the second hollow structural section;

the first outer surface of the second hollow structural section is parallel and opposite the second outer surface of the second hollow structural section.

13. The hollow structural section joint of claim 12, further comprising:

a first auxiliary bracket positioned between the first wing of the first bracket and the first wing of the second bracket, the first auxiliary bracket having a first planar surface secured to both the first outer surface of the second hollow structural section and a first side surface of the first hollow structural section; and a second auxiliary bracket positioned between the second wing of the first bracket and the second wing of the second bracket, the second auxiliary bracket having a second planar surface secured to both the second outer surface of the second hollow structural section and a second side surface of the first hollow structural section, wherein the first side surface of the first hollow structural section is coplanar with the first outer surface of the second hollow structural section, and the second side surface of the first hollow structural section is coplanar with the second outer surface of the second hollow structural section.

14. The hollow structural section joint of claim 8 wherein the bracket secures the first hollow structural section relative to the second hollow structural section such that a gap is formed between the first hollow structural section and the second hollow structural section and the joint is devoid of an interface where the first hollow structural section directly contacts the second hollow structural section.

15. A method of securing a vertical structural member to a horizontal structural member to form a joint, the method comprising:

abutting a lower surface of a bridge of a bracket with an upper surface of the horizontal structural member such that a recess of the bracket is aligned with a hole in the upper surface thereby forming a first interface between the lower surface of the bridge and the upper surface of the horizontal structural member;

securing the bracket to the horizontal structural member by welding along at least a portion of the first interface;

abutting a first inner surface of a first wing of the bracket with a first outer surface of the vertical structural member thereby forming a second interface between the first wing and the first outer surface of the vertical structural member, wherein the first inner surface is perpendicular to the lower surface of the bridge;

abutting a second inner surface of a second wing of the bracket with a second outer surface of the vertical structural member thereby forming a third interface between the second wing and the second outer surface of the vertical structural member, wherein the second inner surface is parallel to the first inner surface, and the second outer surface is parallel to the first outer surface; and securing the bracket to the vertical structural member by welding along at least a portion of the second interface and by welding along at least a portion of the third interface.

16. The method of claim 15 wherein abutting the lower surface of the bridge with the upper surface of the horizontal structural member forms a fourth interface between the first wing and a first outer side surface of the horizontal structural member, the method further comprising:

securing the bracket to the horizontal structural member by welding along at least a portion of the fourth interface, wherein the first outer side surface of the horizontal structural member is coplanar with the first outer surface of the vertical structural member.

17. The method of claim 16 wherein abutting the lower surface of the bridge with the upper surface of the horizontal structural member forms a fifth interface between the second wing and a second outer side surface of the horizontal structural member, the method further comprising:

securing the bracket to the horizontal structural member by welding along at least a portion of the fifth interface, wherein the second outer side surface of the horizontal structural member is coplanar with the second outer surface of the vertical structural member.

18. The method of claim 17, further comprising:

abutting an upper surface of a bridge of a second bracket with a lower surface of the horizontal structural member such that a recess of the second bracket is aligned with a hole in the lower surface thereby forming a sixth interface between the upper surface of the bridge and the lower surface of the horizontal structural member, wherein the lower surface is parallel and opposite the upper surface;

securing the second bracket to the horizontal structural member by welding along at least a portion of the sixth interface;

abutting a first inner surface of a first wing of the second bracket with the first outer surface of the vertical structural member thereby forming a seventh interface between the first wing of the second bracket and the first outer surface of the vertical structural member, wherein the first inner surface of the first wing of the second bracket is perpendicular to the upper surface of the bridge;

abutting a second inner surface of a second wing of the second bracket with the second outer surface of the vertical structural member thereby forming an eighth interface between the second wing of the second bracket and the second outer surface of the vertical structural member, wherein the second inner surface of the second wing of the second bracket is parallel to the first inner surface of the first wing of the second bracket; and securing the second bracket to the vertical structural member by welding along at least a portion of the seventh interface and by welding along at least a portion of the eighth interface.

19. The method of claim 18, further comprising:

abutting an inner surface of an auxiliary bracket with both the first outer surface of the vertical structural member and the first outer side surface of the horizontal structural member;

securing the auxiliary bracket to the horizontal structural member by welding a front edge of the auxiliary bracket to the first outer side surface of the horizontal structural member; and securing the auxiliary bracket to the vertical structural member by welding a rear edge of the auxiliary bracket that is opposite the front edge of the auxiliary bracket to the first outer side surface of the vertical structural member.

20. The method of claim 18, further comprising:

abutting an inner surface of an auxiliary bracket with both the first outer surface of the vertical structural member and the first outer side surface of the horizontal structural member;

securing the auxiliary bracket to the horizontal structural member at a location between the first wing of the first bracket and the first wing of the second bracket by welding a front edge of the auxiliary bracket to the first outer side surface of the horizontal structural member; and securing the auxiliary bracket to the vertical structural member at the location by welding a rear edge of the auxiliary bracket that is opposite the front edge of the auxiliary bracket to the first outer side surface of the vertical structural member.

21. The method of claim 15, further comprising:

abutting an upper surface of a bridge of a second bracket with a lower surface of the horizontal structural member such that a recess of the second bracket is aligned with a hole in the lower surface thereby forming a fourth interface between the upper surface of the bridge of the second bracket and the lower surface of the horizontal structural member;

securing the second bracket to the horizontal structural member by welding along at least a portion of the fourth interface;

abutting a first inner surface of a first wing of the second bracket with the first outer surface of the vertical structural member thereby forming a fifth interface between the first wing of the second bracket and the first outer surface of the vertical structural member, wherein the first inner surface of the first wing of the second bracket is perpendicular to the upper surface of the bridge of the second bracket;

abutting a second inner surface of a second wing of the second bracket with a second outer surface of the vertical structural member thereby forming a sixth interface between the second wing of the second bracket and the second outer surface of the vertical structural member, wherein the second inner surface of the second wing of the second bracket is parallel to the first inner surface of the first wing of the second bracket; and securing the second bracket to the vertical structural member by welding along at least a portion of the fifth interface and by welding along at least a portion of the sixth interface.

22. The method of claim 15, further comprising:

maintaining a gap between the vertical structural member and the horizontal structural member while securing the bracket to the horizontal structural member and while securing the bracket to the vertical structural member.

* * * * *